US007607650B2

(12) United States Patent
Oikawa et al.

(10) Patent No.: US 7,607,650 B2
(45) Date of Patent: Oct. 27, 2009

(54) SHEET-BUNDLE SPINE TREATMENT APPARATUS, SHEET-BUNDLE TREATMENT APPARATUS, AND IMAGE-FORMING APPARATUS

(75) Inventors: Atsuteru Oikawa, Kawasaki (JP); Kenichi Hayashi, Abiko (JP); Toshimasa Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 326 days.

(21) Appl. No.: 11/435,600

(22) Filed: May 17, 2006

(65) Prior Publication Data

US 2006/0263174 A1 Nov. 23, 2006

(30) Foreign Application Priority Data

May 19, 2005 (JP) ..... 2005-147353

(51) Int. Cl.
*B65H 37/04* (2006.01)

(52) U.S. Cl. ..... 270/58.07; 270/32; 270/58.11; 270/58.12

(58) Field of Classification Search ..... 270/32, 270/58.07, 58.11, 58.12; 412/33
See application file for complete search history.

(56) References Cited

U.S. PATENT DOCUMENTS

| | | | | |
|---|---|---|---|---|
| 2,066,620 | A * | 1/1937 | Grammer | 281/27.3 |
| 2,088,904 | A * | 8/1937 | Grammer | 281/15.1 |
| 6,692,208 | B1 | 2/2004 | Watkiss et al. | |
| 7,431,273 | B2 * | 10/2008 | Kamiya et al. | 270/37 |
| 7,431,274 | B2 * | 10/2008 | Kushida et al. | 270/37 |
| 2003/0031532 | A1 * | 2/2003 | Nolte et al. | 412/33 |
| 2005/0179190 | A1 * | 8/2005 | Kamiya et al. | 270/58.07 |
| 2005/0274252 | A1 * | 12/2005 | Wakabayashi et al. | 83/697 |

FOREIGN PATENT DOCUMENTS

| | | |
|---|---|---|
| JP | 2001-260564 A | 9/2001 |
| JP | 2003-182928 A | 7/2003 |

* cited by examiner

*Primary Examiner*—Gene Crawford
*Assistant Examiner*—Leslie A Nicholson, III
(74) *Attorney, Agent, or Firm*—Canon USA Inc IP Div

(57) ABSTRACT

A sheet-bundle spine treatment apparatus includes upper and lower press-rollers for adjusting a crease shape by moving while pinching front and rear surfaces of a spine of a folded sheet-bundle therebetween and a flattening roller for flattening a back of the sheet-bundle by moving while pushing the back of the spine of the sheet-bundle. At least one of the upper and lower press-rollers and the flattening roller is selected so as to allow it to operate.

16 Claims, 25 Drawing Sheets

SHEET-BUNDLE SPINE TREATMENT APPARATUS, SHEET-BUNDLE TREATMENT APPARATUS, AND IMAGE-FORMING APPARATUS

BACKGROUND OF THE INVENTION

1. Field of the Invention

The present invention relates to a sheet-bundle spine treatment apparatus for processing a spine of a folded sheet-bundle, and in particular relates to a sheet-bundle spine treatment apparatus having a crease adjusting function of pinching the spine and a back-flattening function of pushing the back of the spine, a sheet-bundle treatment apparatus including the sheet-bundle spine treatment apparatus, and an image-forming apparatus including the same.

2. Description of the Related Art

Conventionally, the folding of about 20 or less sheets in a seaming/folding device as a folding unit results in booklets. Sheet-bundles folded by the seaming/folding device in such a manner include a simple folded sheet-bundle, a folded sheet-bundle stitched by saddle stitching, and a folded sheet-bundle bound by perfect binding (not with a thread or staple but with an adhesive).

However, since the sheet-bundles have elasticity to some extent, as shown in FIG. 22, the folded product has a U-shaped curved bow adjacent to a spine (folding apex, backbone) Sb. When such sheet-bundles S are stacked, they will not lie flat so that it is difficult to store and transport them in a stacked state.

In order to stack such folded sheet-bundles S flat, a sheet-bundle spine treatment apparatus has been proposed in that the sheet-bundles S are flattened by reducing the bow of the spine Sb as shown in FIG. 8 (see Japanese Patent Laid-Open No. 2001-260564, corresponding to U.S. Pat. No. 6,692,208).

A conventional sheet-bundle spine treatment apparatus is shown in FIGS. 23 to 25. First, in the sheet-bundle spine treatment apparatus 901, the booklet saddle-stitched sheet-bundle S discharged from a folding roller pair 907 in an arrow B direction with the spine Sb in the lead is once stopped by an elevatable stop plate 905 (FIG. 24A). Then, the sheet-bundle spine treatment apparatus 901 grips the sheet-bundle S with gripping members 902 and 903 while elevating the stop plate 905 (FIG. 24B). At this time, the spine Sb protrudes from between the gripping members 902 and 903, while the stop plate 905 separates from the spine Sb. A pressure roller 904 serving as a spine treatment unit presses the spine Sb so as to proceed along the spine Sb in the arrow A direction. Thereby, the curved spine Sb is flattened by being pushed by the pressure roller 904 (see FIG. 25). Finally, the sheet-bundle spine treatment apparatus 901 discharges the treated sheet-bundle S by a discharge belt pair 906 in the arrow B direction into a discharge tray 908 to be stacked (FIG. 24C).

In addition, the conventional sheet-bundle spine treatment apparatus 901 may further serve as a sheet-bundle treatment apparatus so as to flatten the spine of the sheet-bundle folded by a sheet-bundle folder.

Furthermore, the conventional sheet-bundle spine treatment apparatus 901 constituted in the sheet-bundle treatment apparatus may also be incorporated in an image-forming apparatus for forming images on a sheet.

Another conventional sheet-bundle spine treatment apparatus is provided in that the spine folded by a first folding roller pair is pinched between a second folding roller pair different from the first one so as to adjust the shape of a spine crease. During the operation of the second folding roller pair, the first folding roller pair fixedly holds the sheet-bundle (see Japanese Patent Laid-Open No. 2003-182928).

However, in these conventional sheet-bundle spine treatment apparatuses, flattening the spine of the sheet-bundle is performed separately from fortifying the spine. Therefore, an apparatus has been expected to selectively perform flattening the spine of the sheet-bundle and fortifying the spine in one sheet-bundle spine treatment apparatus.

Also, a sheet-bundle treatment apparatus and an image-forming apparatus having such a sheet-bundle spine treatment apparatus have not been easy to use.

SUMMARY OF THE INVENTION

The present invention is directed to a sheet-bundle spine treatment apparatus having a function for adjusting a crease shape by pinching a spine and a function for flattening the back of the spine by pushing the back of the spine with one apparatus so as to selectively perform each of the functions.

The present invention is also directed to a sheet-bundle treatment apparatus having a sheet-bundle spine treatment apparatus capable of easily treating a sheet-bundle with one apparatus by selecting the above-mentioned functions.

The present invention is also directed to an image-forming apparatus having a sheet-bundle spine treatment apparatus capable of easily treating a sheet-bundle with one apparatus by selecting the above-mentioned functions.

According to an aspect of the present invention, a sheet-bundle spine treatment apparatus includes a crease treatment unit configured to move while pinching front and rear surfaces of a spine of a folded sheet-bundle in order to crease the spine; a back treatment unit configured to move while pushing a back of the spine of the sheet-bundle in order to flatten the back of the spine; and a selection portion facilitating selecting operation of at least one of the crease treatment unit and the back treatment unit.

According to another aspect of the present invention, a sheet-bundle treatment apparatus includes a folding unit configured to fold a sheet-bundle and the sheet-bundle spine treatment apparatus provided above.

According to yet another aspect of the present invention, an image-forming apparatus includes an image-forming portion configured to form images on a sheet and a sheet-bundle spine treatment apparatus provided above.

Since the sheet-bundle spine treatment apparatus according to the present invention includes the selection portion which selects at least one of the crease treatment unit and the back treatment unit so as to allow it to operate, at least one of the treatment for creasing the spine of the sheet-bundle and the treatment for flattening the back of the sheet-bundle spine can be selected with one apparatus, so that the treatment of the sheet-bundle spine can be performed in accordance with a user's choice. Also, a plurality of treatments of the sheet-bundle spine are possible with one apparatus, thereby reducing the space and the cost.

Since the sheet-bundle treatment apparatus according to the present invention includes the sheet-bundle spine treatment apparatus capable of selecting at least one of the adjusting treatment of the crease shape of the sheet-bundle spine and the flattening treatment of the spine back of the sheet-bundle in one apparatus, ease of use is improved.

Further features of the present invention will become apparent from the following description of exemplary embodiments with reference to the attached drawings.

DESCRIPTION OF THE EMBODIMENTS

Figure 1:
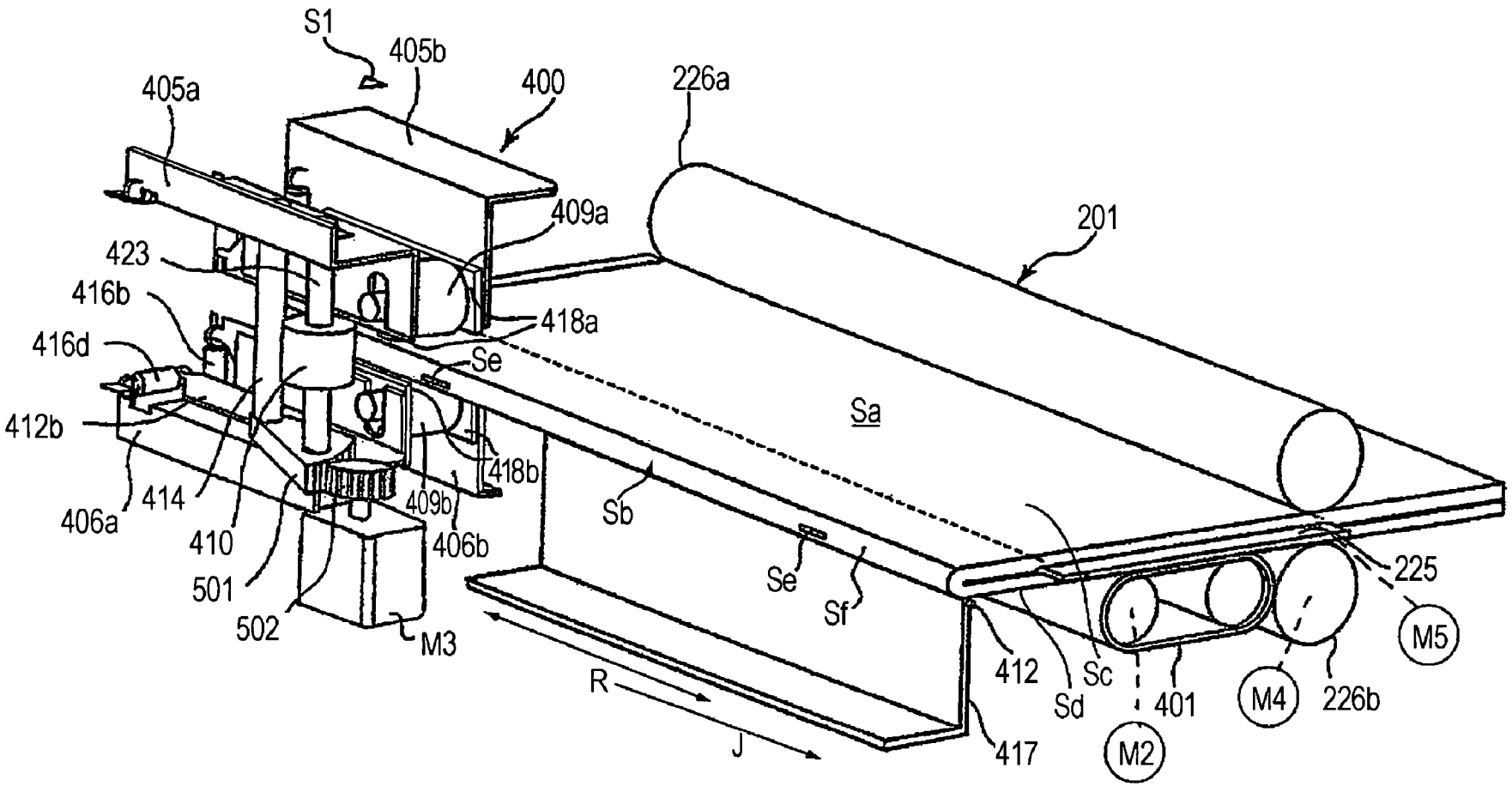
FIG. 1 is an outer perspective view of a sheet-bundle spine treatment apparatus according to an embodiment of the present invention.

A sheet-bundle spine treatment apparatus, a sheet-bundle treatment apparatus, and an image-forming apparatus according to embodiments of the present invention will be described below with reference to the drawings.

An apparatus can incorporate only the sheet-bundle spine treatment apparatus according to the embodiment or alternatively further be incorporated in a sheet-bundle treatment apparatus for folding sheets in a bundled state so as to flatten the spine of the sheet-bundle folded by the sheet-bundle folder.

The sheet-bundle spine treatment apparatus incorporated in the sheet-bundle treatment apparatus may also be incorporated in an image-forming apparatus having an image-forming section for forming images.

(Image-Forming Apparatus)

A monochrome/color copying machine 110 will be described as an image-forming apparatus with reference to FIG. 21. The monochrome/color image forming apparatus 110 includes a monochrome/color copying machine (simply referred to as a copying machine below) body 100 and a finisher 600. The finisher 600 is connected to the copying machine body 100 as a sheet-bundle treatment apparatus, and includes a saddle stitcher 200, a side stitcher 300, and a sheet-bundle spine treatment apparatus 400. The saddle stitcher 200 and the side stitcher 300 constitute a saddle-stitch bookbinding apparatus 700. The finisher 600 may also be optionally used, so that the copying machine body 100 is to be separately used. The finisher 600 may also be integrated with the copying machine body 100.

Four-color toner images are transferred on a sheet supplied from cassettes 107*a* to 107*d* within the copying machine body 100 with yellow, magenta, cyan, and black photosensitive drums 101*a* to 101*d* as image-forming sections, so that the sheet is conveyed to a fuser 111 for fixing the toner images and then discharged outside.

(Finisher)

Figure 21:
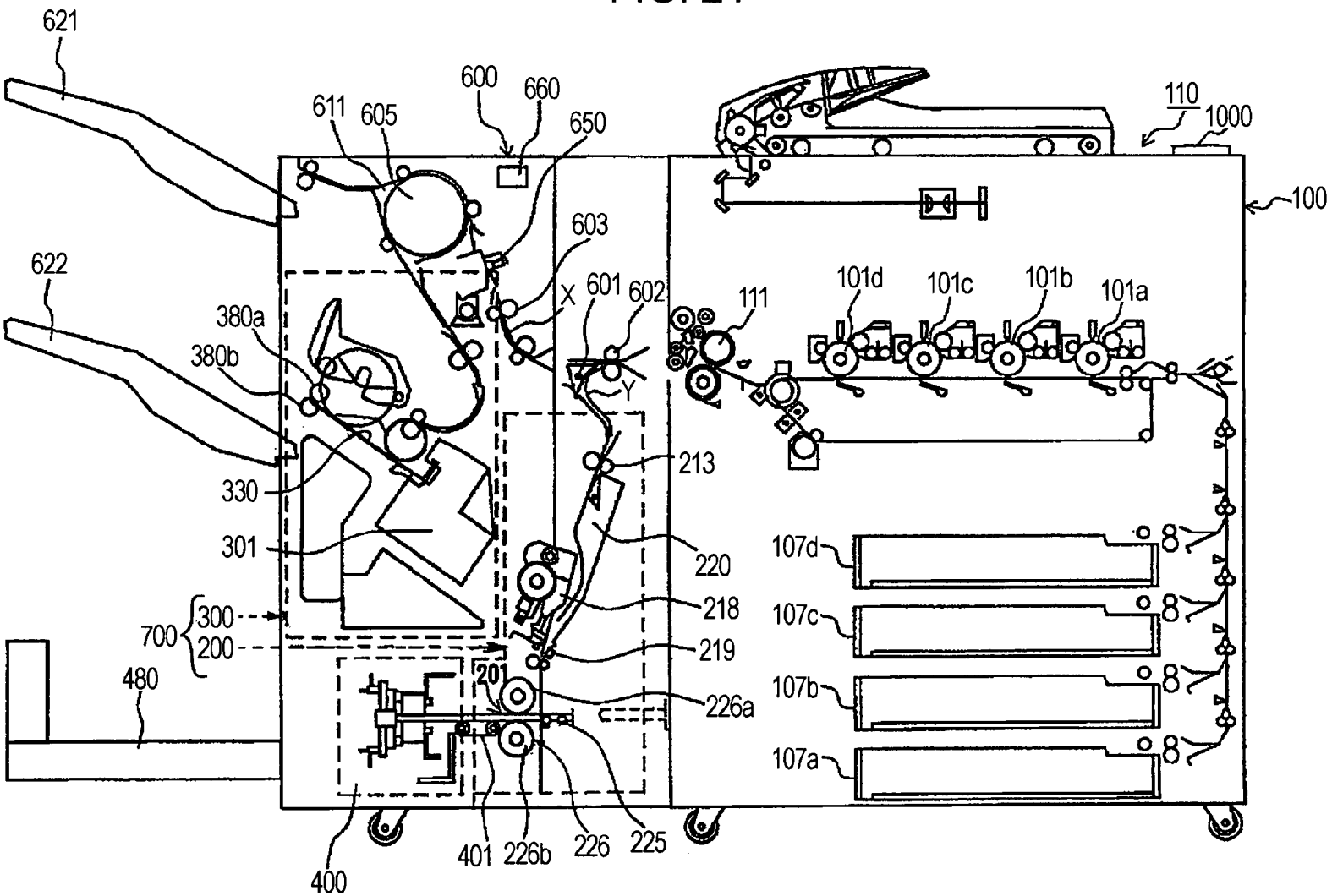
FIG. 21 is a sectional view of an image-forming apparatus along a sheet conveying direction.
Figure 22:
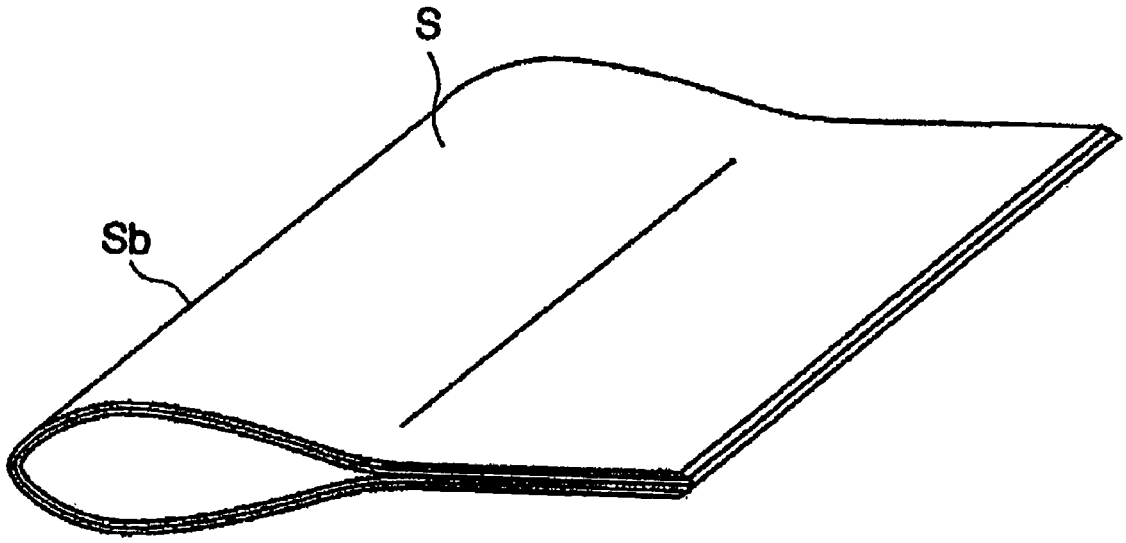
FIG. 22 is a perspective view of a sheet-bundle with a curved spine.
Figure 23:
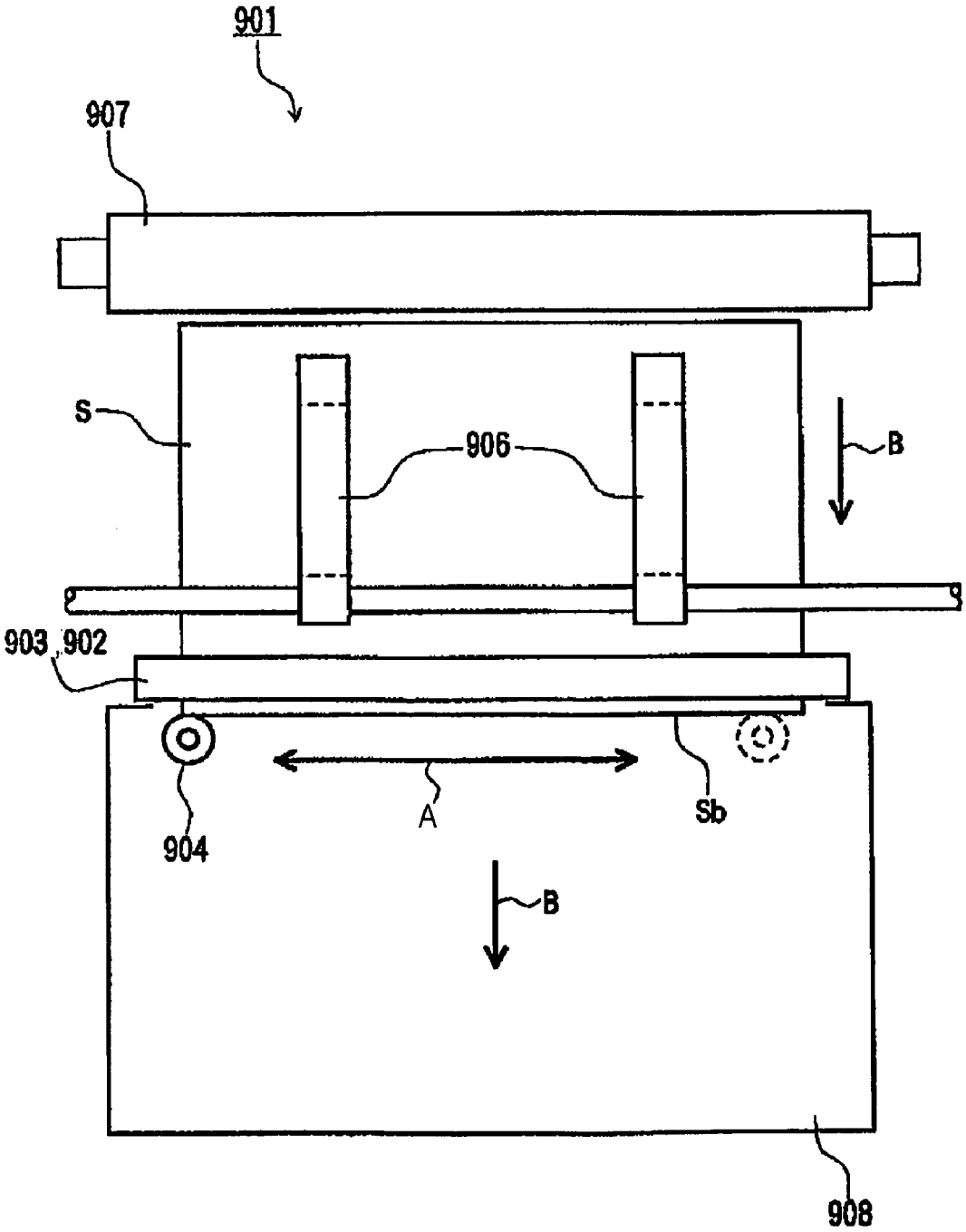
FIG. 23 PRIOR ART
FIG. 23 is a plan view of a conventional apparatus for flattening a sheet-bundle spine.
Figure 24A:
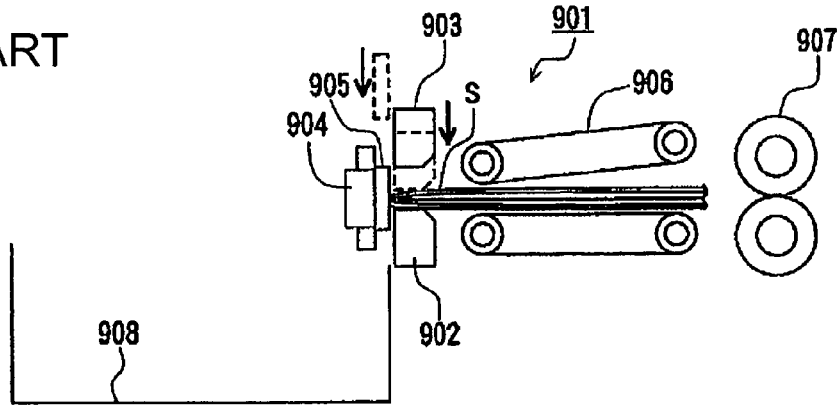
FIG. 24A PRIOR ART
FIG. 24A is a drawing of a state when a pair of grip members receive a sheet-bundle.
Figure 24B:
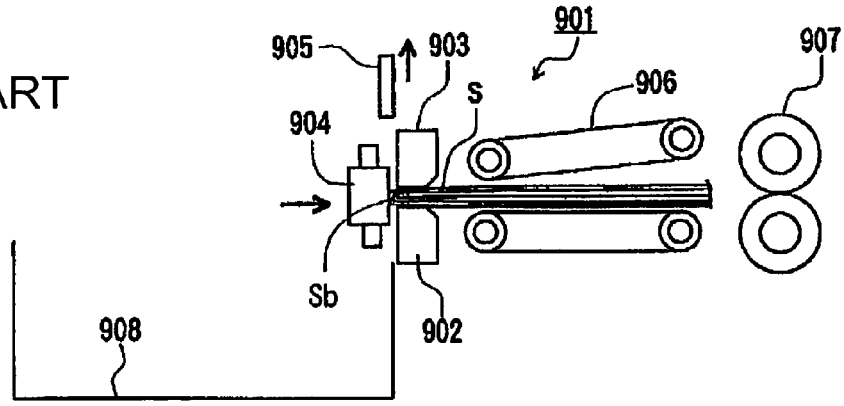
FIG. 24B PRIOR ART
FIG. 24B is a drawing of a state when a pair of the grip members grip a sheet-bundle while a pushing roller flattens the spine.
Figure 24C:
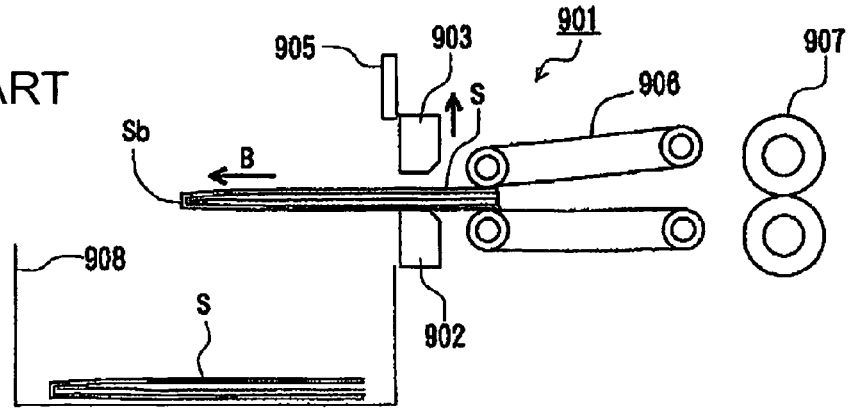
FIG. 24C PRIOR ART
FIG. 24C is a drawing of a state when the sheet-bundle is discharged by a discharge belt pair.
Figure 25:
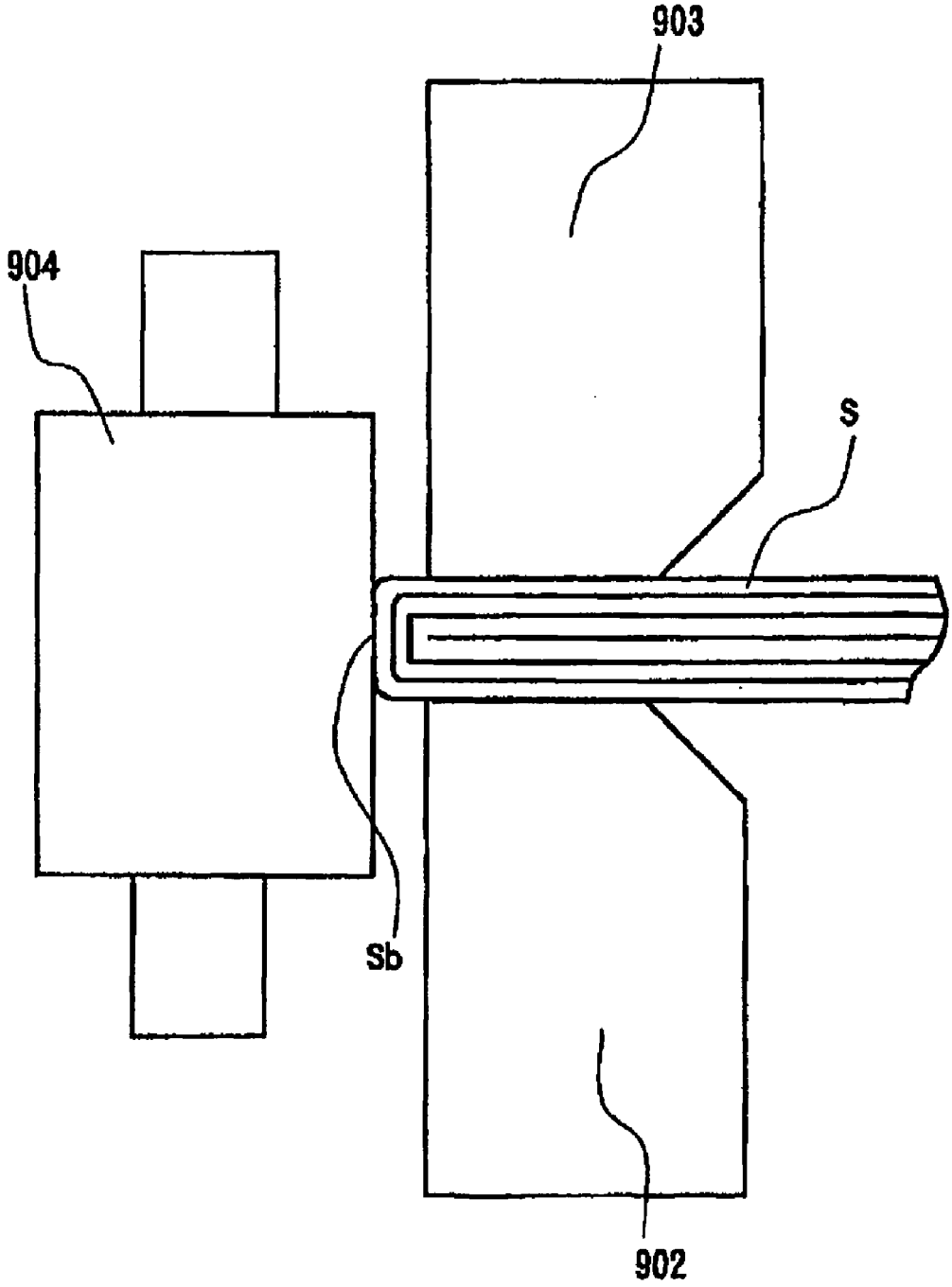
FIG. 25 PRIOR ART
FIG. 25 is an enlarged view of the spine of FIGS. 24A to 24C.

Referring to FIG. 21, the sheet discharged from the copying machine body 100 is conveyed to the finisher 600. The finisher 600 sequentially receives sheets discharged from the copying machine body 100 so as to perform various types of sheet post-processing, such as bundle processing for aligning a plurality of the received sheets so as to bundle them into one bundle, staple processing for stitching the trailing end of the sheet-bundle with a stapler 301, punch processing for punching the vicinity of the trailing end of the sheet-bundle, sort processing, non-sort processing, folding processing for folding the sheet-bundle, and book-bind processing. The finisher 600 according to the embodiment can perform at least the folding processing.

The finisher 600 includes an entry roller pair 602 for introducing sheets discharged from the copying machine body 100 inside. On the downstream side of the entry roller pair 602, a switching flapper 601 is provided for selectively introducing the sheet to a side-stitch book-binding path X or a saddle-stitch book-binding path Y.

The sheet introduced to the side-stitch book-binding path X is conveyed toward a buffer roller 605 via a conveying roller pair 603. The conveying roller pair 603 and the buffer roller 605 are reversible in revolution. Between the conveying roller pair 603 and the buffer roller 605, a punch unit 650 is provided for punching the vicinity of the trailing end if necessary.

The buffer roller 605 can wrap a predetermined number of sheets around its outer periphery with multiple layers. The sheet transferred to the buffer roller 605 is placed either on a sample tray 621 with a switching flapper 611 arranged downstream or on an intermediate tray 330 within the side stitcher 300 (also referred to as a processing tray).

The sheets placed in a bundle on the processing tray 330 are discharged to a stack tray 622 with discharge rollers 380*a* and 380*b* after the aligning processing and the staple processing have been performed thereon if necessary. The stapler 301 is used for the staple processing for stitching the sheets placed in a bundle on the processing tray 330. The stapler 301 stitches the corner or the back of the sheet-bundle.

The sheet introduced to the switching flapper 601 is accommodated in an accommodation guide 220 with a conveying roller pair 213, and it is further conveyed to a position where the leading end of the sheet abuts an elevatable sheet positioning member (not shown). At an intermediate position of the accommodation guide 220, two pairs of staplers 218 are provided (only one pair is shown in FIG. 21 because of overlapping). The stapler 218 stitches the center of the sheet-bundle with an opposing anvil 219.

In addition, in the following drawings, symbol Se designates a side gauge of the sheet-bundle stitched by the stapler 218.

On the downstream side of the stapler 218, a folding roller pair 226*a* and 226*b* is provided. At a position opposing the folding roller pair 226*a* and 226*b*, a protruding member 225 is provided. The leading end of the protruding member 225 opposes the nip between the folding roller pair 226*a* and 226*b*. The folding roller pair 226*a* and 226*b* and the protruding member 225 constitute a sheet folding device 201 for folding the sheet-bundle.

When the sheet-bundle stitched with the stapler 218 is folded, after completion of the staple processing, the above-mentioned positioning member (not shown) descends so that the stapling position of the sheet-bundle opposes the center (nip) of the folding roller pair 226*a* and 226*b*. Then, as the protruding member 225 protrudes toward the sheet-bundle, the sheet-bundle is pushed into the nip between the folding roller pair 226*a* and 226*b*, so that the sheet-bundle is folded into two while being pinched and conveyed with the folding roller pair 226*a* and 226*b*. Accordingly, the sheet-bundle is formed into a saddle-stitched booklet. The sheet-bundle may also be folded without being saddle-stitched.

The saddle-stitched booklet sheet-bundle is conveyed to the sheet-bundle spine treatment apparatus 400 by the protruding member 225 and a booklet bundle conveying belt 401.

Figure 20:
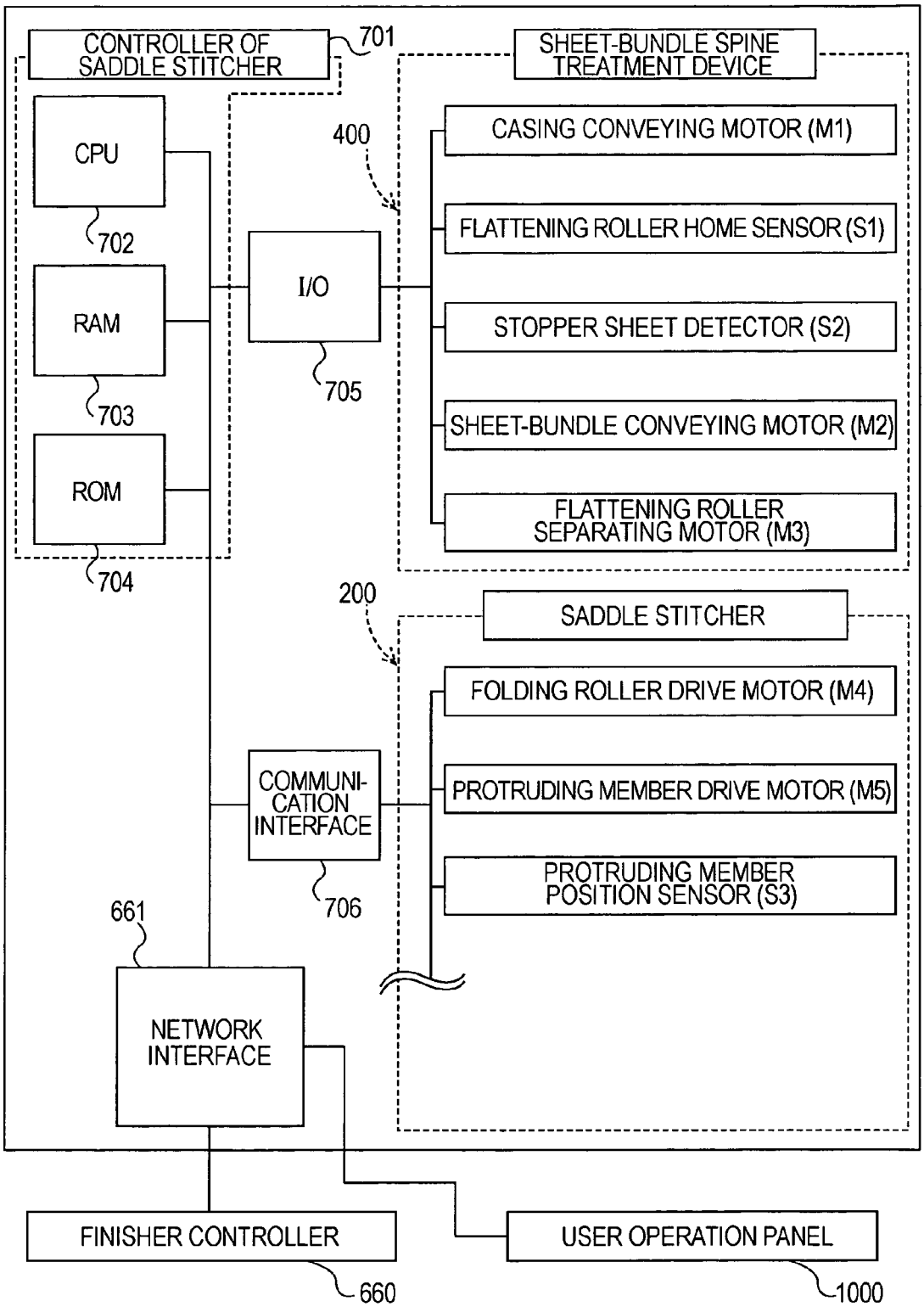
FIG. 20 is a control block diagram of the sheet-bundle spine treatment apparatus.

As shown in FIG. 20, a controller 701 of the saddle-stitch bookbinding apparatus 700 is connected to a finisher controller 660 for controlling the finisher 600 via a network interface 661, and includes a CPU 702, a RAM 703, and a ROM 704. The CPU 702 controls the sheet-bundle spine treatment apparatus 400 and the saddle stitcher 200 while interchanging a signal with the finisher controller 660. The RAM 703 stores the processing information of the sheet-bundle spine treatment apparatus 400 and the saddle stitcher 200. The ROM 704 stores the control procedure of the saddle-stitch bookbinding apparatus 700. The sheet-bundle spine treatment apparatus 400 is connected to the CPU 702, etc., via an I/O 705. The saddle stitcher 200 and a user operation panel 1000 are connected to the CPU 702, etc., via a communication interface 706.

(First Embodiment of Sheet-Bundle Spine Treatment Apparatus)

(Structure Description)

The structure of the sheet-bundle spine treatment apparatus 400 will be described with reference to FIGS. 1 to 13. As shown in FIG. 2, according to the present invention, the spine Sb designates an aggregation of the front surface Sc, the back Sf, and the rear surface Sd of the folded sheet-bundle Sa. The front and rear surfaces Sc and Sd are also those of the entire sheet bundle. In the description below, the front surface and the rear surface may also be referred to as the top surface and the bottom surface, respectively.

Figure 2:
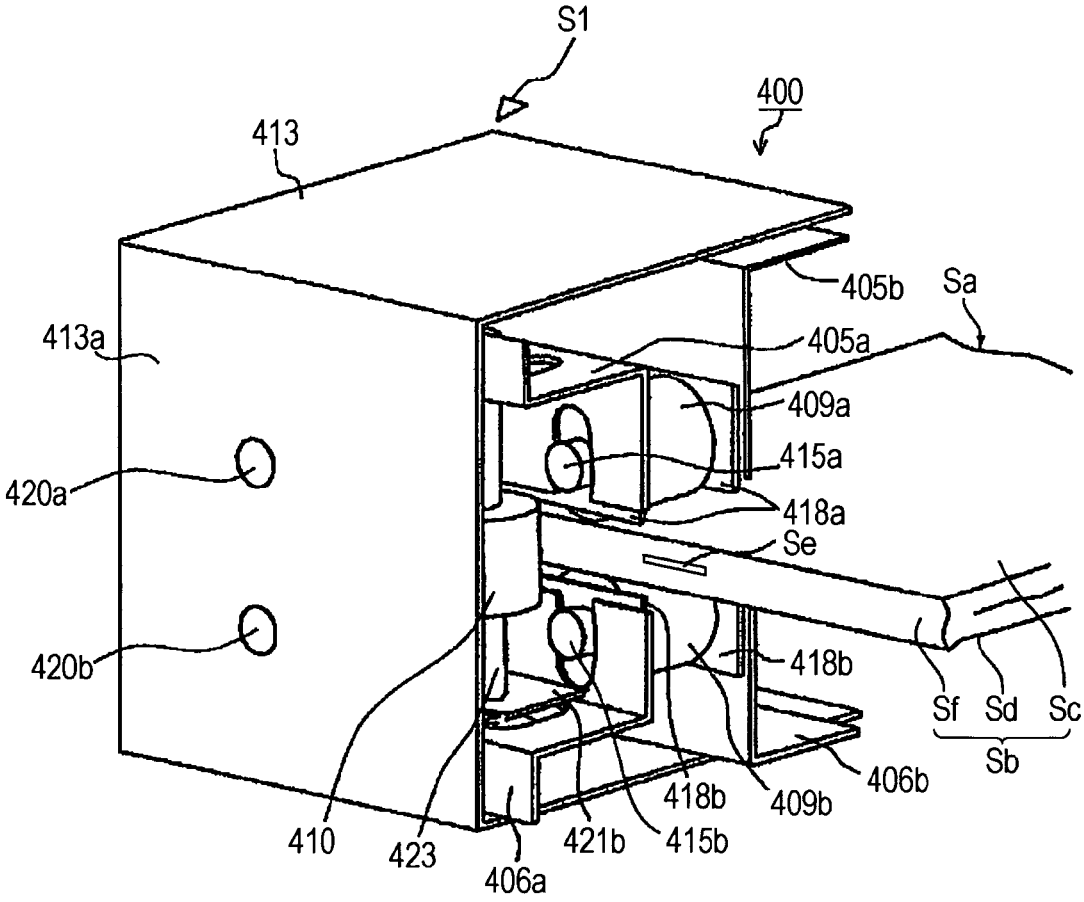
FIG. 2 is a partial outer view of the sheet-bundle spine treatment apparatus.

As shown in FIG. 1, a stopper 417, rotatably supported by a rotation center shaft 412, is rotated in the vertical direction by a drive source (not shown), such as a motor and a solenoid, for positioning the leading end of the folded sheet-bundle Sa (the spine Sb).

Figure 3:
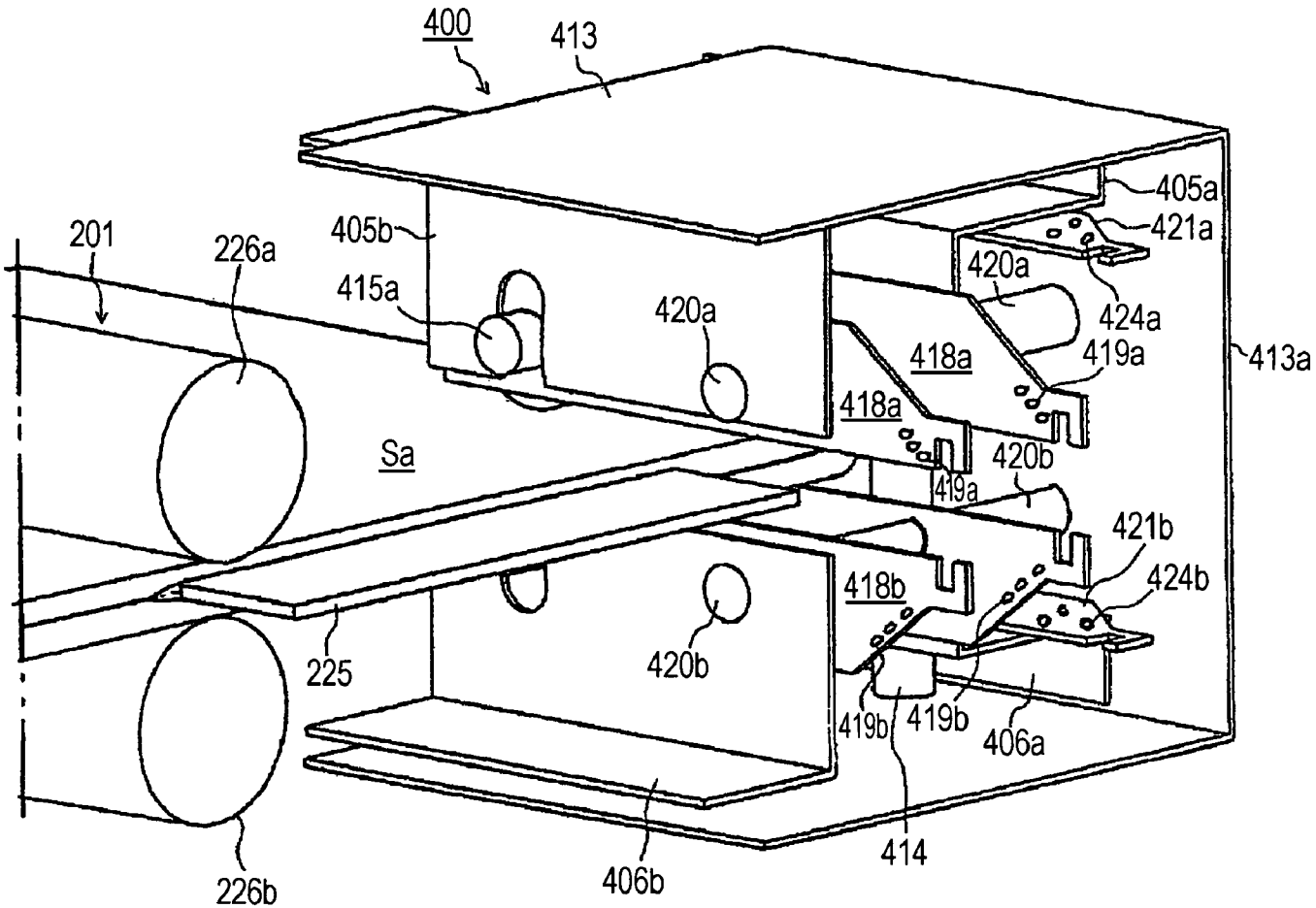
FIG. 3 is an outer view of the sheet-bundle spine treatment apparatus viewed from a sheet-bundle.

A casing 413 shown in FIGS. 2 and 3 has a roughly horseshoe-shaped section, and accommodates an upper press roller 409*a*, a lower press roller 409*b*, a flattening roller 410, and members associated therewith so as to support them therein as a unit. The casing 413 is moved on an endless belt or chain (not shown) circulating by a casing conveying motor M1 shown in FIG. 20.

The casing 413 is shown only in FIGS. 2 and 3, and it is omitted in the other drawings to clearly show the structure.

The casing 413 is provided with upper side plates 405*a* and 405*b* and lower side plates 406*a* and 406*b* fixed thereto. Between the upper side plate 405*a* and the lower side plate 406*a*, a flattening-roller fulcrum shaft 414 is rotatably stretched across in the vertical direction. Furthermore, the flattening-roller fulcrum shaft 414 is provided with a sector gear 501, to which a flattening-roller shaft 423 is fixed. The sector gear 501 is engaged with a pinion gear 502 rotated by a flattening-roller separation motor M3. Thus, when the flattening-roller separation motor M3 rotates, the pinion gear 502 and the sector gear 501 are rotated so as to move the flattening roller 410.

The sector gear 501, the pinion gear 502, and the flattening-roller separation motor M3 constitute a transfer unit.

Between a side plate 413*a* and the upper side plate 405*b* of the casing 413, an upper press-roller fulcrum shaft 420*a* is rotatably stretched across in a roughly horizontal direction. Between the side plate 413*a* and the lower side plate 406*b* of the casing 413, a lower press-roller fulcrum shaft 420*b* is rotatably stretched across in a roughly horizontal direction.

Figure 4:
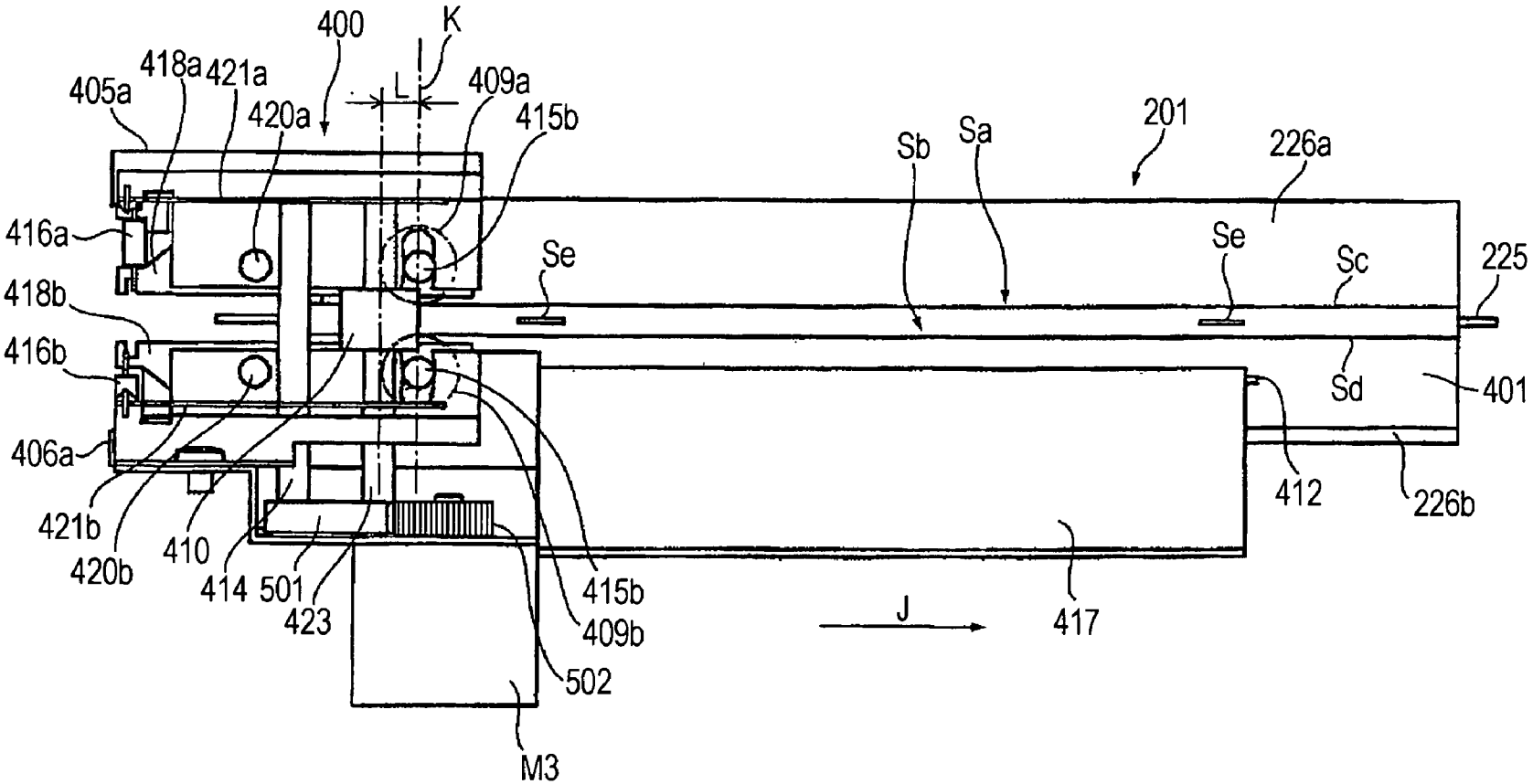
FIG. 4 is a front view of the sheet-bundle spine treatment apparatus of FIG. 1.

The upper press-roller fulcrum shaft 420*a* is integrally provided with a pair of upper press-roller press arms 418*a*. At ends of the pair of the upper press-roller press arms 418*a*, an upper press-roller shaft 415*a* having the upper press roller 409*a* attached thereto is rotatably provided in a roughly horizontal direction. The upper press roller 409*a* can be a roller. As shown in FIG. 4, between the other ends of the pair of the upper press-roller press arms 418*a* and the upper side plate 405*a* (or the casing 413), an upper press-roller spring 416*a* is provided for urging the upper press roller 409*a* to the folded sheet-bundle Sa.

The lower press-roller fulcrum shaft 420*b* is integrally provided with a pair of lower press-roller press arms 418*b*. At ends of the pair of the lower press-roller press arms 418*b*, a lower press-roller shaft 415*b* having the lower press roller 409*b* attached thereto is rotatably provided in a roughly horizontal direction. The lower press roller 409*b* can be a roller. As shown in FIG. 4, between the other ends of the pair of the lower press-roller press arms 418*b* and the lower side plate 406*a* (or the casing 413), a lower press-roller spring 416*b* is provided for urging the lower press roller 409*b* to the folded sheet-bundle Sa.

The upper and lower press rollers 409*a* and 409*b*, serving as pinching members, and the upper and lower press-roller springs 416*a* and 416*b* constitute a crease treatment unit.

Thus, the casing 413 is rotatably provided with the pair of upper press-roller press arms 418*a* having the upper press roller 409*a* integrally with the upper press-roller fulcrum shaft 420*a*. Also, the casing 413 is rotatably provided with the pair of lower press-roller press arms 418*b* having the lower press roller 409*b* integrally with the lower press-roller fulcrum shaft 420*b*. Hence, between the upper press roller 409*a* and the lower press roller 409*b*, the front and rear surfaces Sc and Sd in the vicinity of the spine Sb of the folded sheet-bundle Sa are pinched from both sides by tensile forces of the upper and lower press-roller springs 416*a* and 416*b*.

Figure 6A:
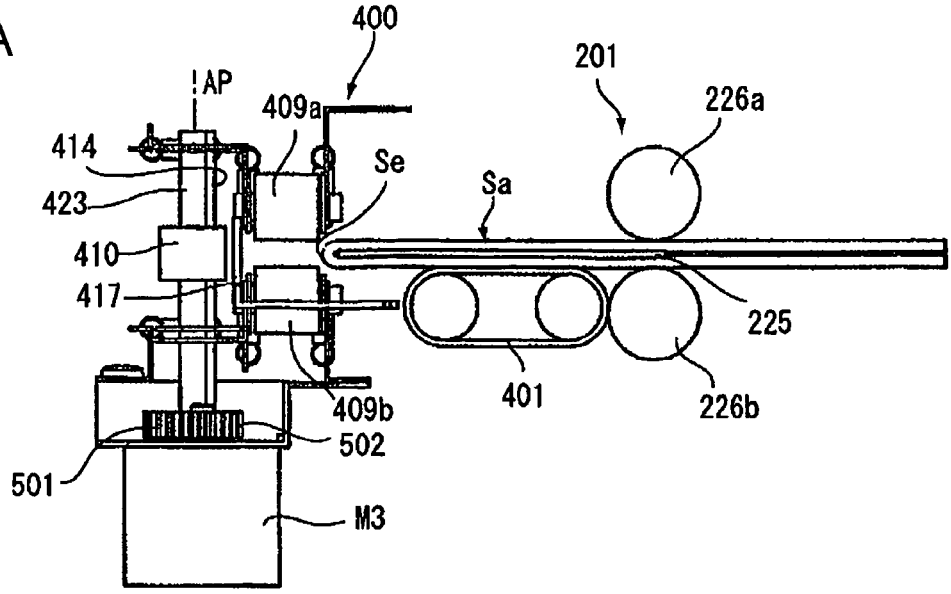
FIG. 6A is a drawing of the sheet-bundle spine treatment apparatus when the sheet-bundle is received.
Figure 6B:
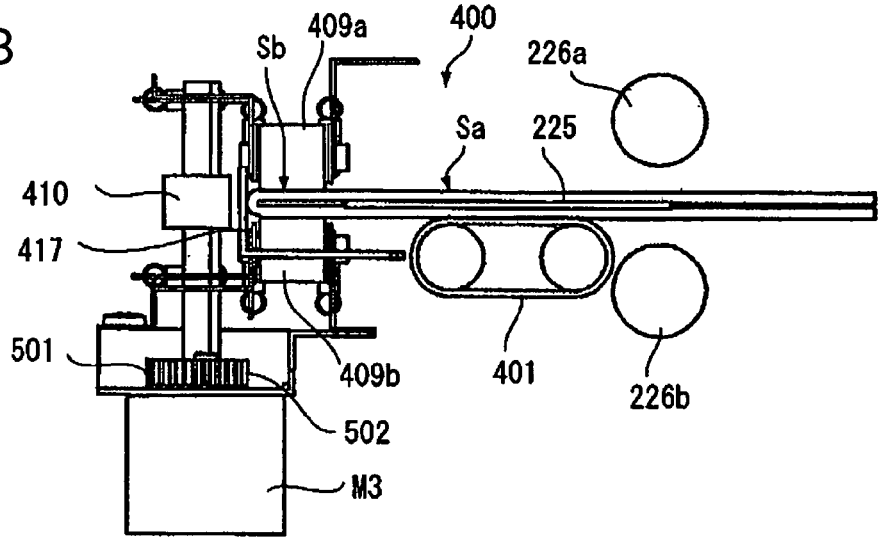
FIG. 6B is a drawing of a state when the sheet-bundle is stopped by a stopper.
Figure 6C:
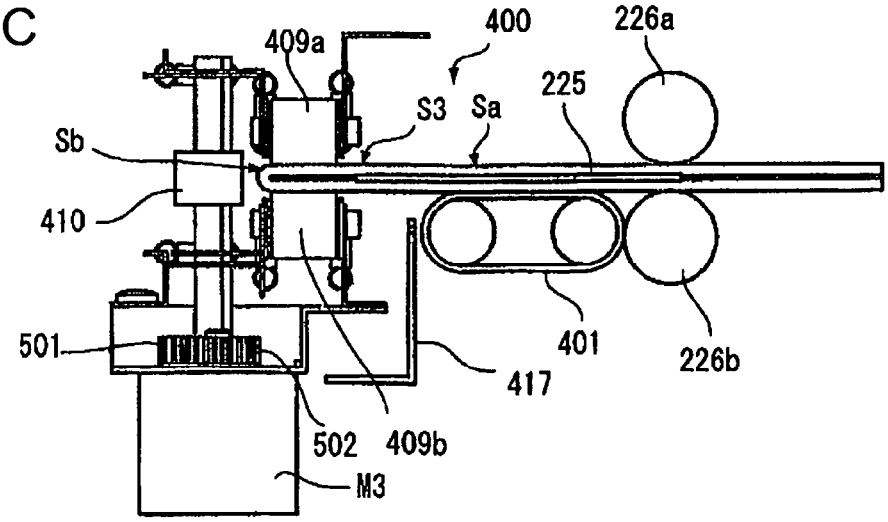
FIG. 6C is a drawing of a state when the stopper is evacuated.

As shown in FIG. 3, the sheet pinching force due to the upper and lower press rollers 409*a* and 409*b* can be adjusted by selecting upper and lower pinching-force adjustment holes 419*a* and 419*b* formed in the upper and lower press-roller press arms 418*a* and 418*b*, respectively, as a plurality of pinching-force adjustment members, so as to adjust lengths of the upper and lower press-roller springs 416*a* and 416*b* by changing their hooking positions (see FIGS. 6A to 6C).

In the vicinities of both ends of the flattening-roller fulcrum shaft 414 rotatably provided across between the upper and lower side plates 405*a* and 406*a*, upper and lower flattening-roller press arms 421*a* and 421*b* are integrally provided. At one end of the upper and lower flattening-roller press arms 421*a* and 421*b*, the flattening roller 410 is provided around the vertically directed and rotatable flattening-roller shaft 423.

Figure 5:
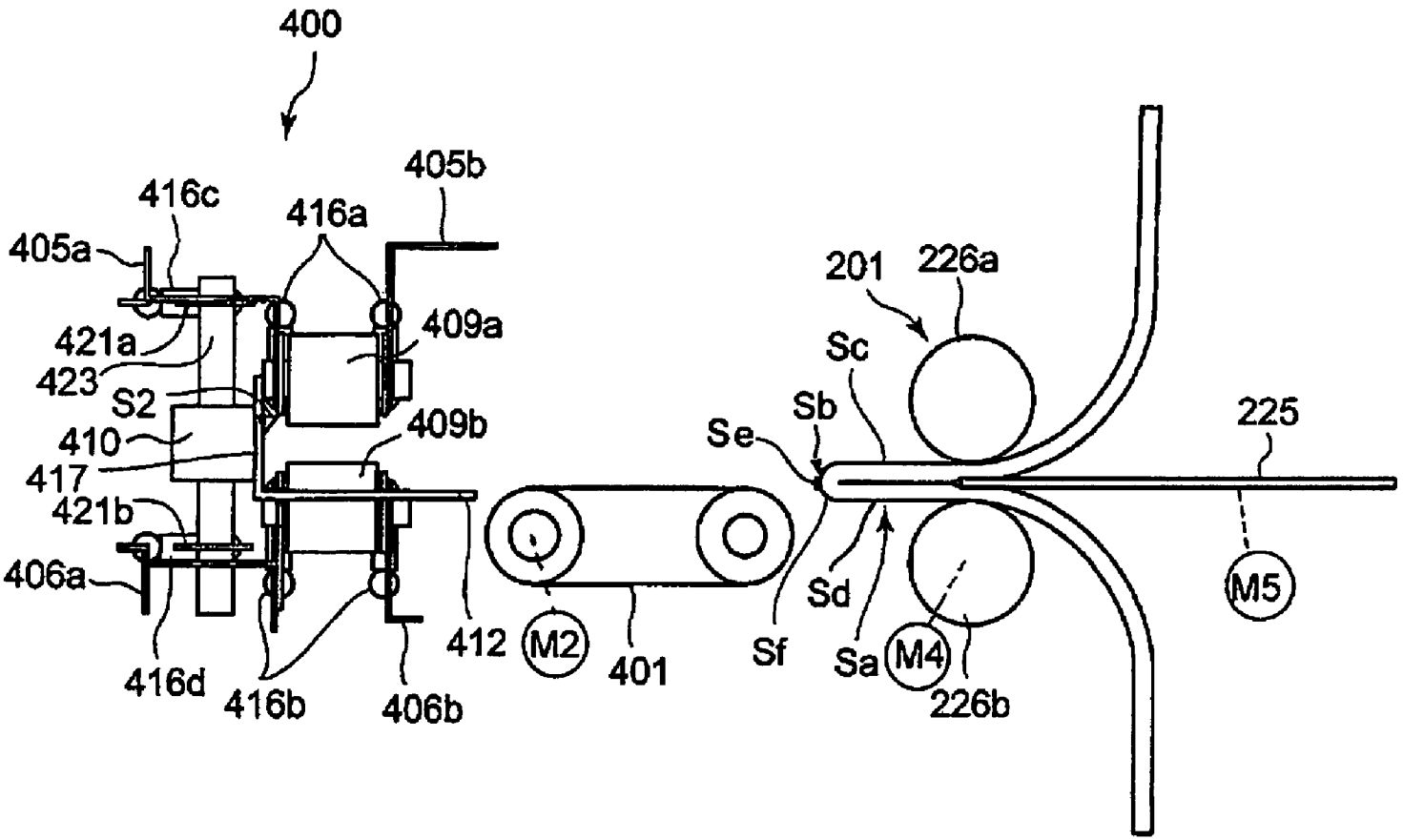
FIG. 5 is a drawing of the sheet-bundle spine treatment apparatus of FIG. 1 in a state when the sheet-bundle is folded.

Between the other ends of the upper and lower flattening-roller press arms 421*a* and 421*b* and the upper and lower side plates 405*a* and 406*a* (or the casing 413), upper and lower flattening-roller springs 416*c* and 416*d* are provided for pressing the flattening roller 410 to the spine Sb of the sheet bundle (see FIG. 5). Thereby, the flattening roller 410 can be precisely controlled in position, while the force pushing the spine Sb of the sheet-bundle can be maintained constant, by eliminating the backlash between the sector gear 501 and the pinion gear 502 of the flattening-roller separation motor M3.

The force of the flattening roller 410 pushing the spine Sb of the sheet-bundle, as shown in FIG. 3, can be adjusted by selecting a plurality of upper and lower pushing-force adjustment holes 424*a* and 424*b* formed in the upper and lower flattening-roller press arms 421*a* and 421*b*, respectively, so as to adjust lengths of the upper and lower flattening-roller springs 416*c* and 416*d* by changing their hooking positions (see FIG. 5).

The flattening roller 410 and the upper and lower flattening-roller springs 416*c* and 416*d* constitute a spine treatment unit as pushing members.

According to the embodiment, the pinching force is adjusted by changing the extension stroke of the press springs. Alternatively, the same effect can be obtained by simply changing the spring or changing the arm ratio of the press arms. For example, the casing 413 may be provided with a hooking plate adjustable in position arranged at the position hooking the upper and lower press-roller springs 416*a* and 416*b*, so that the pinching force may be adjusted by changing the lengths of the upper and lower press-roller springs 416*a* and 416*b*.

Also, the pinching force may be adjusted by changing the number of sheets of a booklet, the basis weight of the sheet constituting the booklet, the kind of images of the sheet in relation to contact positions of the upper and lower press rollers 409*a* and 409*b* and the flattening roller 410 to the sheet-bundle. That is, the distance L of FIG. 4 may be adjusted.

As shown in FIG. 4, the contact positions of the upper and lower press rollers 409*a* and 409*b* to the sheet-bundle precede the contact position of the flattening roller 410 to the sheet-bundle by the distance L in the moving direction J for flattening the spine of the sheet-bundle. In addition, the flattening roller 410 may not be necessarily located at the position following thereto by the distance L, and it may be positioned at the same position as those of the upper and lower press rollers 409*a* and 409*b*.

In the structure described above, the casing conveying motor M1 shown in FIG. 20 facilitates moving the casing 413. A home sensor S1 of the flattening roller 410 is located in the position shown in FIGS. 1 and 2 so as to detect whether the flattening roller 410 is located at the home position or not via the casing 413. A stopper sheet detector S2 is located in the position shown in FIG. 5 so as to detect the leading end (the spine Sb) of the sheet-bundle stopped by the stopper 417. A sheet-bundle conveying motor M2 (see FIGS. 1, 5, and 20) drives the booklet bundle conveying belt 401. The flattening-roller separation motor M3 (see FIGS. 1 and 4) controls the position of the flattening roller 410 relative to the spine Sb of the sheet-bundle. A folding roller drive motor M4 (see FIGS. 1, 5, and 20) in the saddle stitcher 200 (see FIG. 21) drives the folding roller pair 226*a* and 226*b* to rotate. A protruding member drive motor M5 reciprocates the protruding member 225. A protruding member position sensor S3 is arranged at the position shown in FIG. 6C so as to detect the position of the protruding member 225 protruding to the utmost.

(Operation Description)

(Fortifying Processing of the Spine of the Sheet-Bundle (Pinching of the Spine))

Referring to FIGS. 6A to 6C, the upper and lower press rollers 409*a* and 409*b* are in contact with each other when they do not clamp the folded sheet-bundle Sa therebetween. However, they are separated for making the drawings distinct. When only fortifying the crease of the sheet-bundle, the flattening roller 410 is moved in an evacuated position AP by the flattening-roller separation motor M3, the pinion gear 502, and the sector gear 501. Thus, even when the sheet-bundle spine treatment apparatus 400 moves in the R direction (FIG. 1), the flattening roller 410 cannot be brought into contact with the sheet-bundle.

As shown in FIG. 6A, the sheet-bundle Sa saddle-stitched and folded by the folding roller pair 226*a* and 226*b* and the protruding member 225 is conveyed to the stopper 417 by the folding roller pair 226*a* and 226*b*, the protruding member 225, and the booklet bundle conveying belt 401. At this time, the nip line K (see FIG. 4) of the upper and lower press rollers 409*a* and 409*b* is located outside the end face of the folded sheet-bundle Sa. Before the spine Sb of the folded sheet-bundle Sa abuts the stopper 417, as shown in FIG. 6B, the folding roller pair 226*a* and 226*b* is separated from the folded sheet-bundle Sa. Then, the booklet bundle conveying belt 401 conveys the folded sheet-bundle Sa until the folded sheet-bundle Sa abuts the stopper 417. When the leading end of the folded sheet-bundle Sa (the spine Sb) abuts the stopper 417, any skewing of the end is corrected. Thereafter, as shown in FIG. 6C, the stopper 417 is evacuated downward.

Figure 7A:
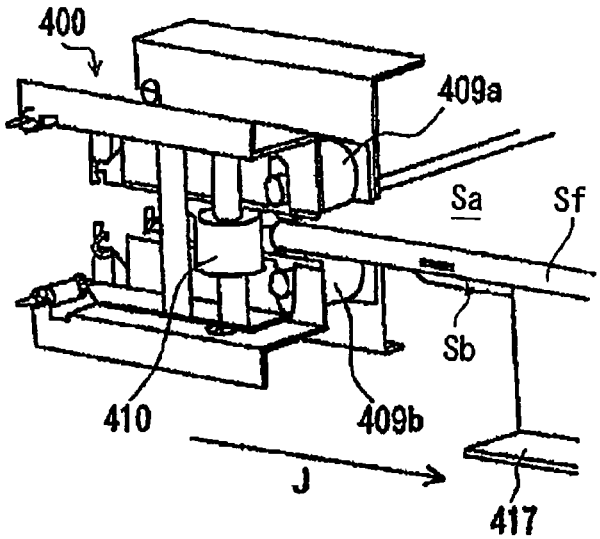
FIG. 7A is a drawing of a state when fortifying the sheet-bundle spine is started.
Figure 7B:
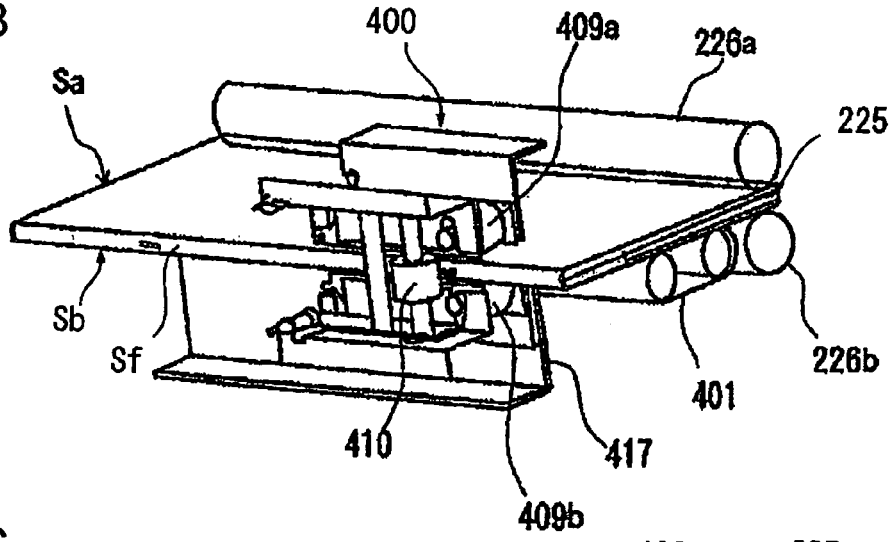
FIG. 7B is a drawing of a state when the sheet-bundle spine is fortified.

When the leading end (the spine Sb) of the folded sheet-bundle Sa is positioned, as shown in FIG. 7A, the sheet-bundle spine treatment apparatus 400 starts moving in the arrow J direction. Then, the upper and lower press rollers 409*a* and 409*b* pinch the front and rear surfaces Sc and Sd of the spine Sb therebetween.

While the sheet-bundle spine treatment apparatus 400 is fortifying the spine Sb of the folded sheet-bundle Sa (adjusting the crease shape of the spine Sb), the end and the intermediate portion of the folded sheet-bundle Sa are supported by the booklet bundle conveying belt 401, the protruding member 225, and the folding roller pair 226*a* and 226*b* while the rear portion thereof is pinched between the folding roller pair 226*a* and 226*b*. Hence, the sheet-bundle is scarcely dragged by the sheet-bundle spine treatment apparatus 400, thereby hardly being displaced. In addition, instead of the folding roller pair 226*a* and 226*b*, a conveying roller pair may also be used.

Figure 7C:
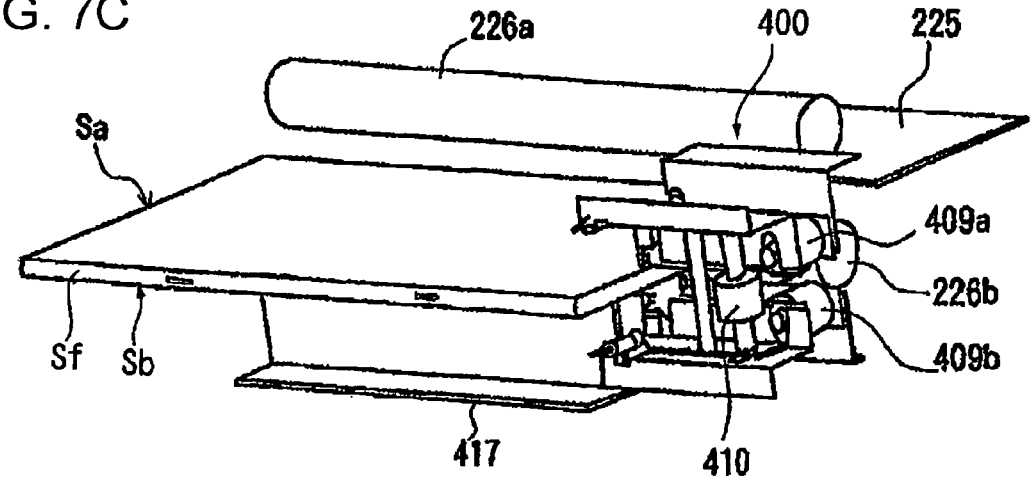
FIG. 7C is a drawing of a state when the sheet-bundle is discharged after fortifying the sheet-bundle spine was finished.

When the sheet-bundle spine treatment apparatus 400 moves to the other end of the sheet-bundle, it completes fortifying the spine Sb. Consequently, the sheet-bundle spine treatment apparatus 400 can adjust the crease shape by reducing the bulge of the spine Sb of the sheet-bundle. Then, as shown in FIG. 7C, the folding roller pair 226*a* and 226*b* is again separated from the folded sheet-bundle Sa. Then, the protruding member 225, which has supported the sheet-bundle so as to prevent the folded sheet-bundle Sa from hanging down while the sheet-bundle spine treatment apparatus 400 was fortifying the spine, is evacuated to the rear of the folding roller pair 226*a* and 226*b* for preparing saddle stitching of the next sheet-bundle. The folded sheet-bundle Sa with the flattened front and rear surfaces Sc and Sd of the spine Sb is discharged to a discharge tray 480 and sequentially placed thereon.

Figure 8:
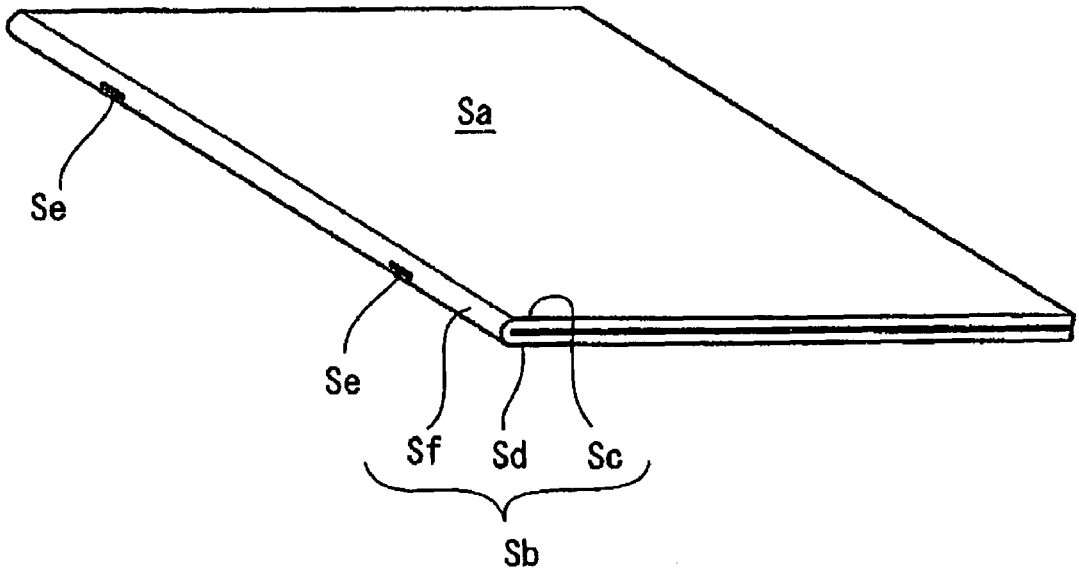
FIG. 8 is a perspective view of a sheet-bundle with the spine fortified in the sheet-bundle spine treatment apparatus.

As shown in FIG. 8, the bulge of the spine Sb (backbone) can be reduced by the series of processing performed by the sheet-bundle spine treatment apparatus 400 so as to provide high-quality sheet-bundles.

(Simultaneous Fortifying Processing of the Spine of the Sheet-Bundle (Pinching of the Spine) and Flattening Processing of the Back)

Figure 9A:
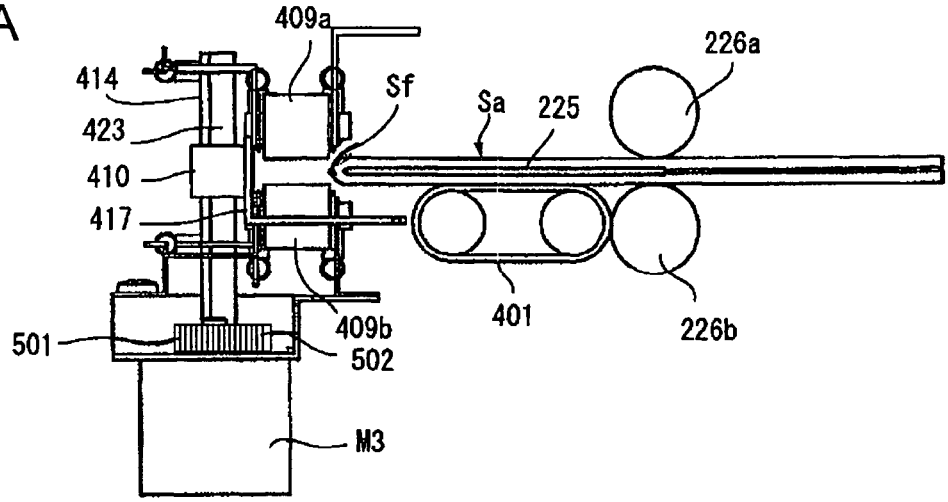
FIG. 9A is a drawing of the sheet-bundle spine treatment apparatus when the sheet-bundle is received.
Figure 9B:
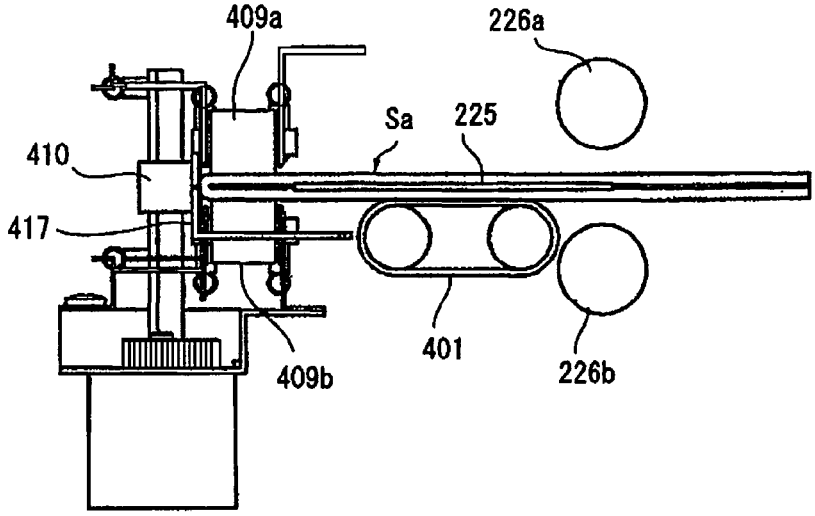
FIG. 9B is a drawing of a state when the sheet-bundle is stopped by a stopper.
Figure 9C:
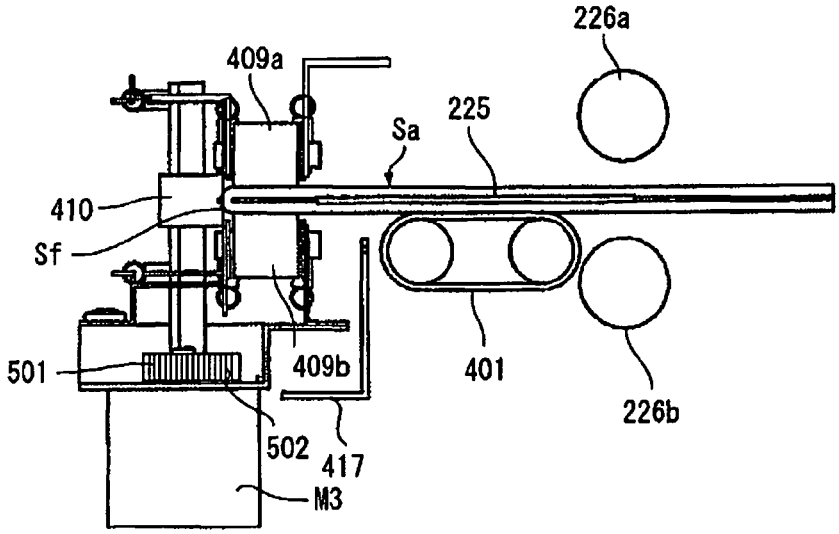
FIG. 9C is a drawing of a state when the stopper is evacuated.

Referring to FIGS. 9A to 9C, the upper and lower press rollers 409*a* and 409*b* are in contact with each other when they do not clamp the folded sheet-bundle Sa therebetween. However, they are separated for making the drawings distinct. When simultaneously fortifying the crease of the sheet-bundle and flattening the back, the flattening roller 410 is moved to a position abutting the back Sf of the sheet-bundle by the flattening-roller separation motor M3, the pinion gear 502, and the sector gear 501. Thus, when the sheet-bundle spine treatment apparatus 400 moves in the R direction (FIG. 1), the flattening roller 410 is always in contact with the back Sf of the sheet-bundle.

As shown in FIG. 9A, the sheet-bundle Sa saddle-stitched and folded by the folding roller pair 226*a* and 226*b* and the protruding member 225 is conveyed to the stopper 417 by the folding roller pair 226*a* and 226*b*, the protruding member 225, and the booklet bundle conveying belt 401. At this time, the nip line K (see FIG. 4) of the upper and lower press rollers 409*a* and 409*b* is located outside the end face of the folded sheet-bundle Sa. Before the spine Sb of the folded sheet-bundle Sa abuts the stopper 417, as shown in FIG. 9B, the folding roller pair 226*a* and 226*b* is separated from the folded sheet-bundle Sa. Then, the booklet bundle conveying belt 401 conveys the folded sheet-bundle Sa until the folded sheet-bundle Sa abuts the stopper 417. When the leading end of the folded sheet-bundle Sa (the spine Sb) abuts the stopper 417, any skewing of the end is corrected. Thereafter, as shown in FIG. 9C, the stopper 417 is evacuated downward.

Figure 10A:
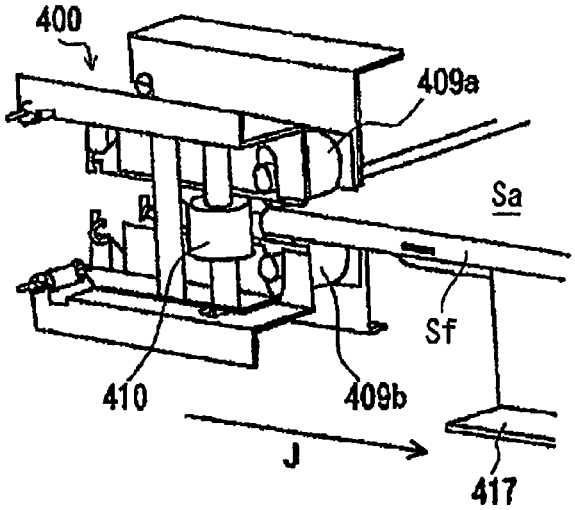
FIG. 10A is a drawing of a state when fortifying and flattening the sheet-bundle spine are started.
Figure 10B:
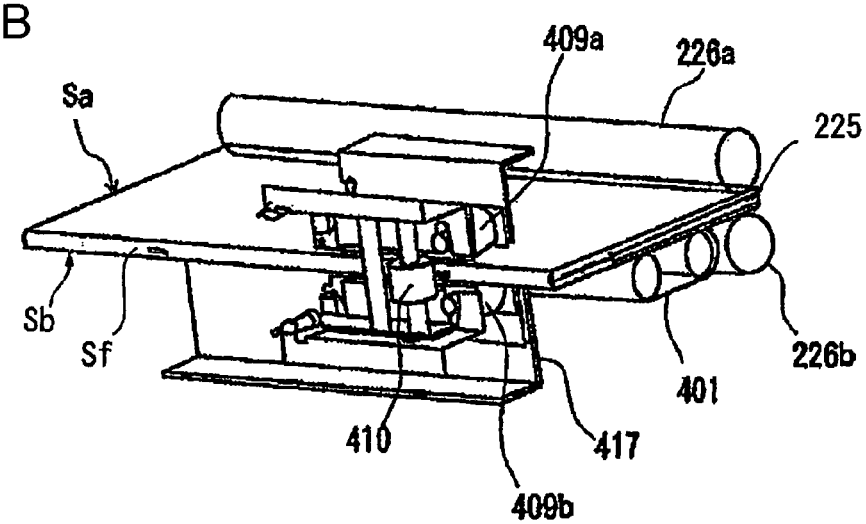
FIG. 10B is a drawing of a state when the sheet-bundle spine is fortified and flattened.

When the leading end of the folded sheet-bundle Sa is positioned, as shown in FIG. 10A, the sheet-bundle spine treatment apparatus 400 starts moving in the arrow J direction. Then, the upper and lower press rollers 409*a* and 409*b* pinch the front and rear surfaces Sc and Sd of the spine Sb therebetween. Then, the flattening roller 410 flattens the back Sf of the folded sheet-bundle Sa while pushing the back Sf of the spine Sb in retard to the upper and lower press rollers 409*a* and 409*b* by the distance L (see FIG. 4) so as to follow them.

While the sheet-bundle spine treatment apparatus 400 is processing the spine of the folded sheet-bundle, the end and the intermediate portion of the folded sheet-bundle are supported by the booklet bundle conveying belt 401, the protruding member 225, and the folding roller pair 226*a* and 226*b* while the rear portion thereof is pinched between the folding roller pair 226*a* and 226*b*. Hence, the sheet-bundle is scarcely dragged by the sheet-bundle spine treatment apparatus 400, thereby hardly being displaced. The sheet-bundle spine treatment apparatus 400 (or the protruding member 225) and the folding roller pair 226*a* and 226*b* constitute a holding unit.

Figure 10C:
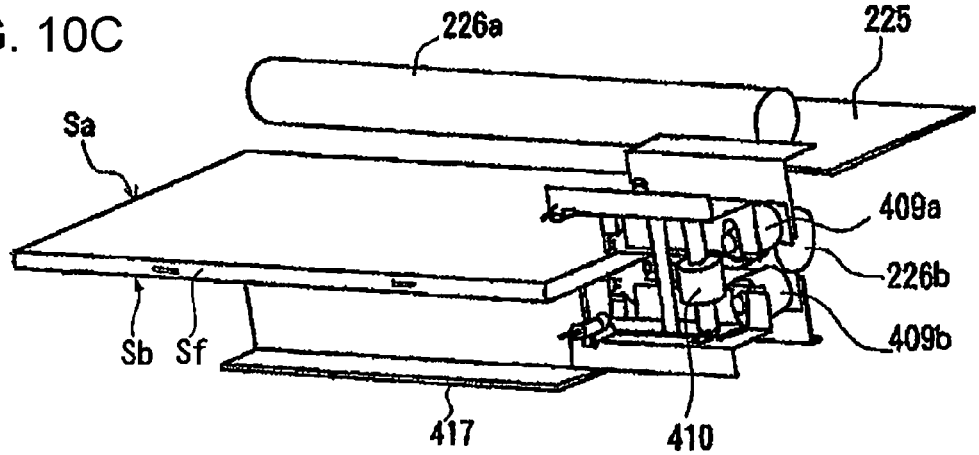
FIG. 10C is a drawing of a state when the sheet-bundle is discharged after fortifying and flattening the sheet-bundle spine were finished.

When the sheet-bundle spine treatment apparatus 400 moves to the end of the sheet-bundle, it completes fortifying the spine and flattening the back. Consequently, the sheet-bundle spine treatment apparatus 400 can adjust the crease shape by reducing the bulge of the spine Sb of the sheet-bundle as well as can flatten the back Sf. Then, as shown in FIG. 10C, the folding roller pair 226*a* and 226*b* is again separated from the folded sheet-bundle Sa. Then, the protruding member 225, which has supported the sheet-bundle so as to prevent the folded sheet-bundle Sa from hanging down while the sheet-bundle spine treatment apparatus 400 is processing the spine, is evacuated to the rear of the folding roller pair 226*a* and 226*b* for preparing the saddle stitching of the next sheet-bundle. The folded sheet-bundle Sa with the flattened front and rear surfaces Sc and Sd of the spine Sb is discharged to the discharge tray 480 (see FIG. 21) and sequentially placed thereon.

Figure 11:
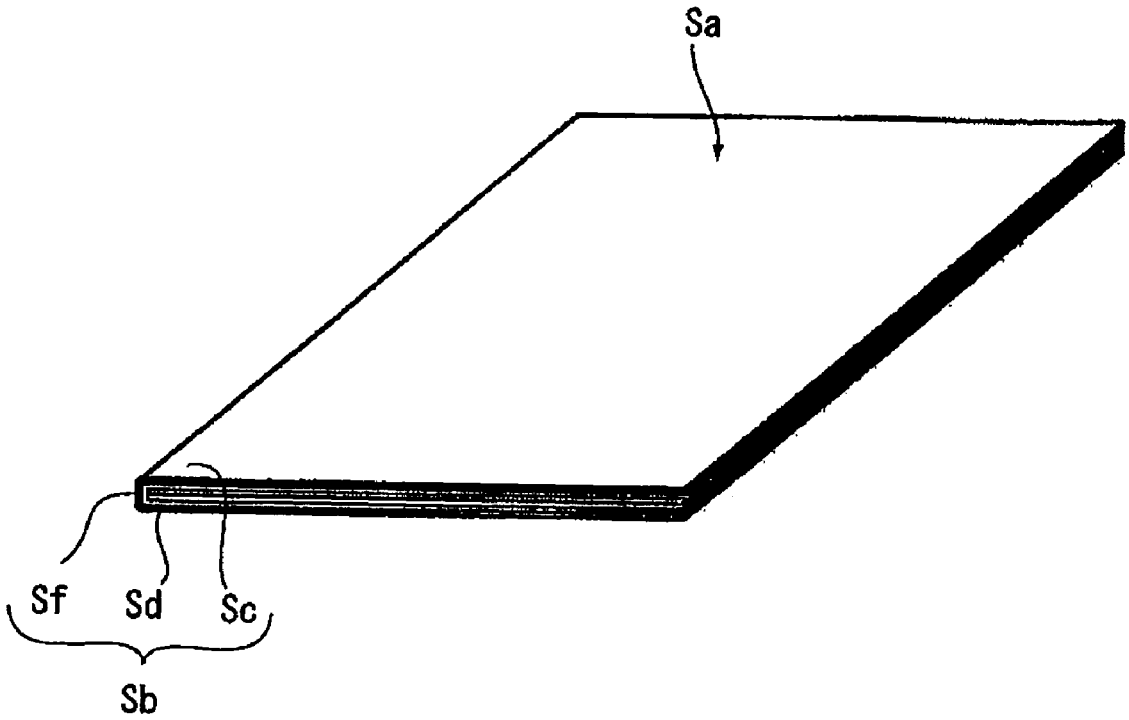
FIG. 11 is a perspective view of a sheet-bundle with a fortified and flattened spine.

As shown in FIG. 11, the bulge of the spine Sb can be reduced so as to have a small flattened and angular shape by the series of processing performed by the sheet-bundle spine treatment apparatus 400 so as to provide high-quality sheet-bundles.

Figure 12:
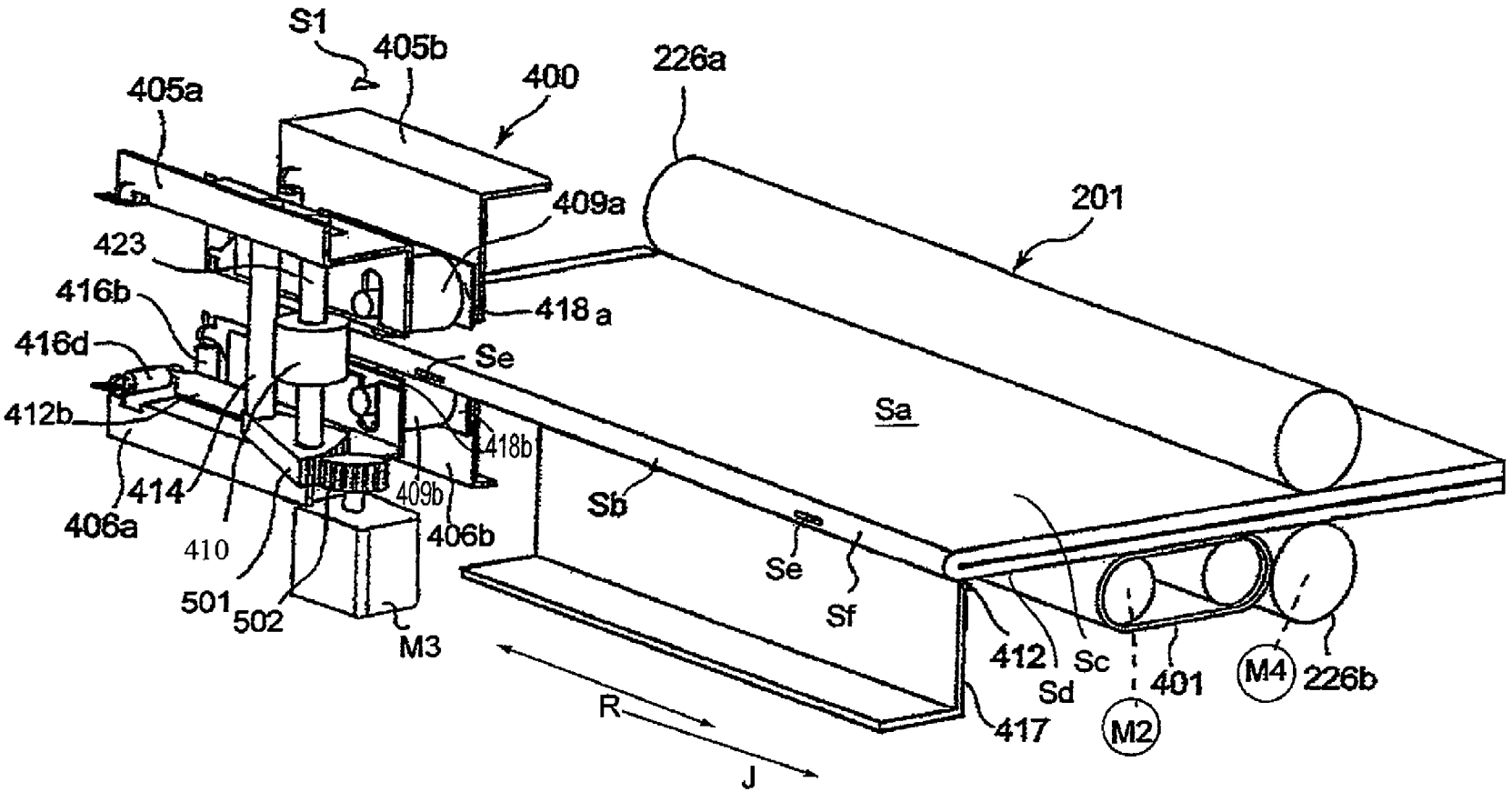
FIG. 12 is a perspective view of the sheet-bundle spine treatment apparatus when the sheet-bundle is treated after a protruding member was drawn.

In addition, as shown in FIG. 12, the sheet-bundle may not be necessarily supported by the protruding member 225. The sheet-bundle may also be supported by the booklet bundle conveying belt 401 (not shown in FIG. 12) so as to pinch the sheet-bundle with the folding roller pair 226*a* and 226*b* therebetween.

As described above, the sheet-bundle spine treatment apparatus 400 according to the embodiment can selectively perform the fortifying processing for fortifying the spine crease (reducing the bulge) by running with the upper and lower press rollers 409*a* and 409*b* pinching the front and rear surfaces Sc and Sd in the vicinity of the spine therebetween and the flattening processing for flattening the back Sf (forming it in an angular shape) of the sheet-bundle in the vicinity of the both surfaces pinched by the upper and lower press rollers 409*a* and 409*b* by the running of the flattening roller 410 along with the running of the upper and lower press rollers 409*a* and 409*b* pinching the front and rear surfaces Sc and Sd in the vicinity of the spine therebetween.

Figure 13:
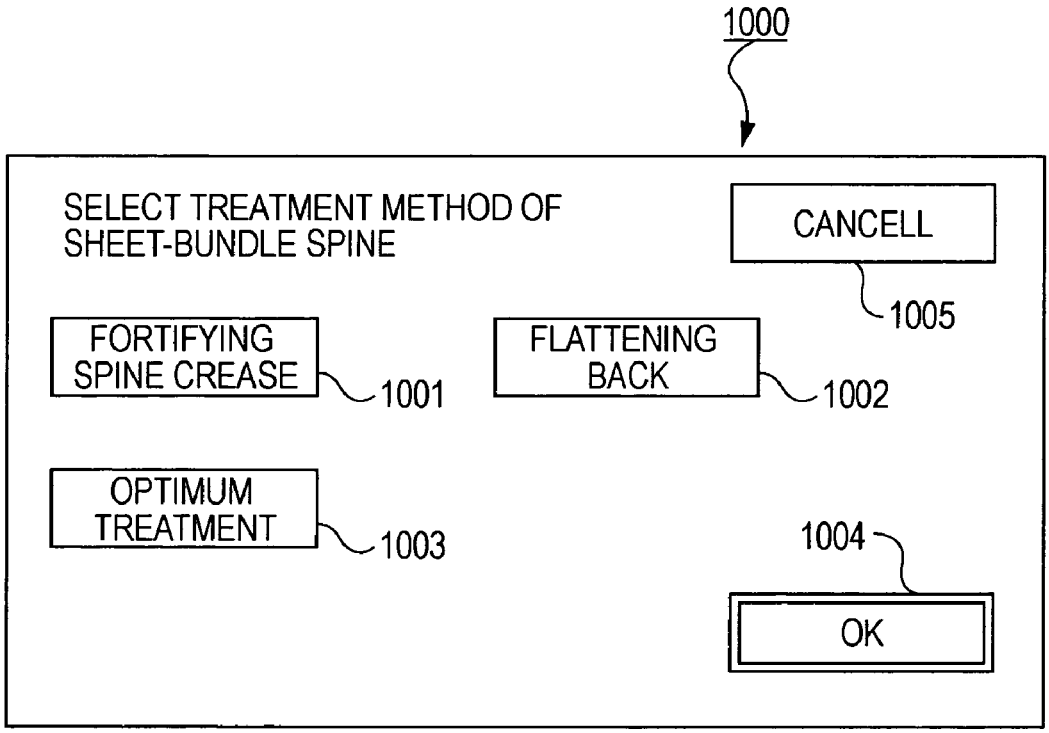
FIG. 13 is a plan view of a user operation panel.
Figure 14:
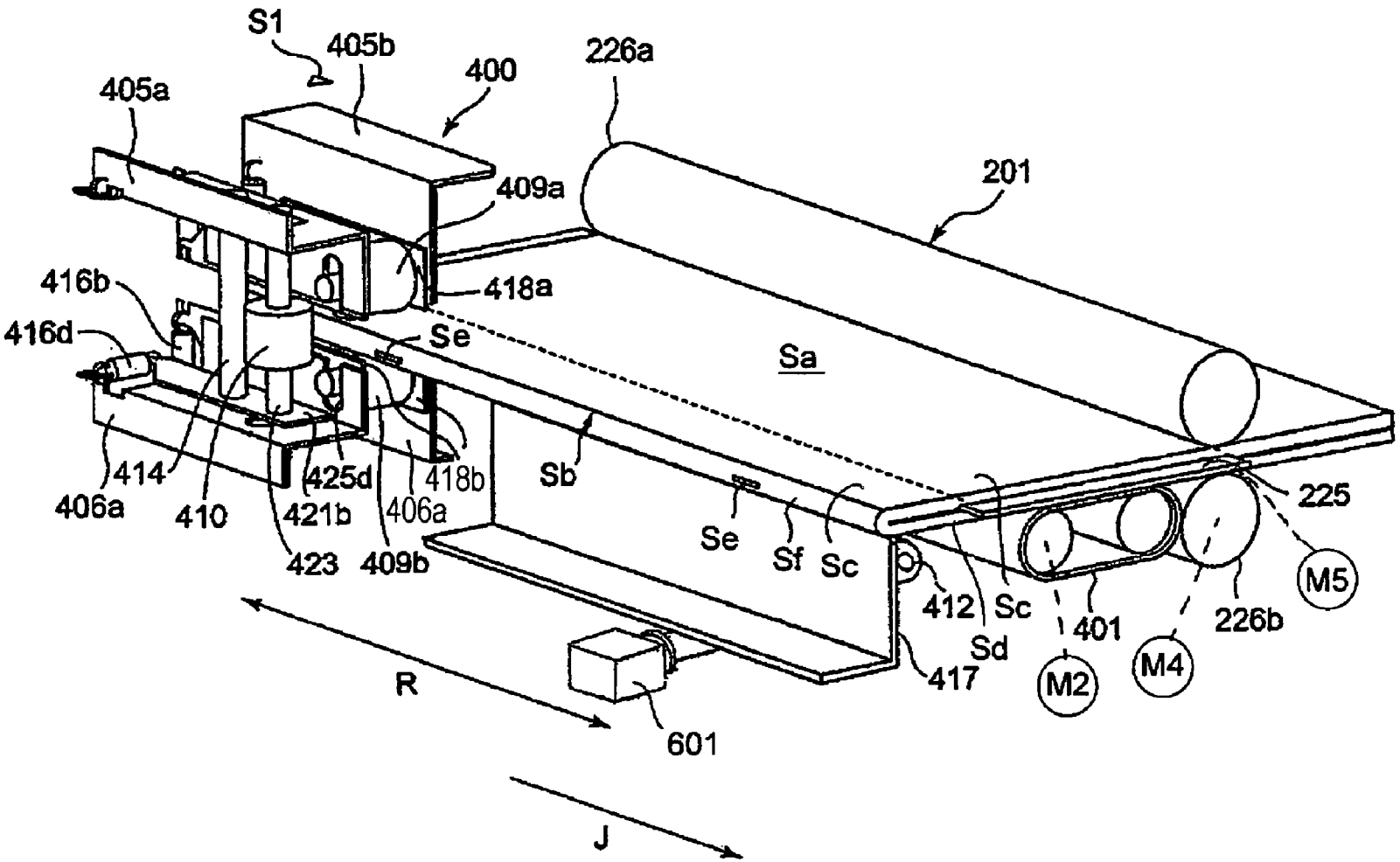
FIG. 14 is an outer perspective view of a sheet-bundle spine treatment apparatus according to a second embodiment of the present invention.

The processing is selected by a choice of a user who pushes whether a "fortifying spine crease" button 1001 or a "flattening back" button 1002 on the user operation panel 1000 shown in FIG. 13.

When the "fortifying spine crease" button 1001 is selected, the controller 701 of the saddle-stitch bookbinding apparatus moves the flattening roller 410 to the evacuated position AP (see FIG. 6A) where the flattening roller 410 is not in contact with the spine Sb of the sheet-bundle by the flattening-roller separation motor M3. Then, upon rotating the casing conveying motor M1 (see FIG. 20), the sheet-bundle spine treatment apparatus 400 moves along the spine Sb of the sheet-bundle so as to fortify the spine crease.

When the "flattening back" button 1002 is selected, the controller 701 of the saddle-stitch bookbinding apparatus moves the flattening roller 410 to a position where the flattening roller 410 can contact the spine Sb of the sheet-bundle from the evacuated position AP by the flattening-roller separation motor M3. Then, upon rotating the casing conveying motor M1 (see FIG. 20), the sheet-bundle spine treatment apparatus 400 moves along the spine Sb of the sheet-bundle so as to fortify the spine crease and flatten the back.

Furthermore, when a user selects an "optimum treatment" button 1003, the controller 701 of the saddle-stitch bookbinding apparatus shown in FIG. 20 selects the fortifying spine crease processing and the flattening back processing when the thickness of the sheet-bundle is large (10 mm or more, for example) and selects only the fortifying spine crease processing when thickness of the sheet-bundle is small (less than 10 mm, for example) so as to allow the sheet-bundle spine treatment apparatus 400 to perform the processing.

The user operation panel 1000 and the controller 701 of the saddle-stitch bookbinding apparatus constitute a selection unit.

In such a manner, the sheet-bundle spine treatment apparatus 400 according to the embodiment can perform the sheet-bundle treatment with one apparatus, which has been only performed by separate apparatuses. Moreover, a user can select the processing. Furthermore, the optimum treatment for the sheet-bundle can be automatically selected in accordance with the thickness of the sheet-bundle.

(Second Embodiment of Sheet-Bundle Spine Treatment Apparatus)

In the sheet-bundle spine treatment apparatus 400 according to the first embodiment described above, there is one position where the stopper 417 receives the sheet-bundle. Hence, the flattening roller 410 moves relative to the casing 413. That is, when the back is flattened simultaneously with fortifying the spine of the sheet-bundle, the flattening roller 410 is moved to the one position by the sector gear 501, the pinion gear 502, and the flattening-roller separation motor M3 so as to stand ready to abut the spine Sb of the folded sheet-bundle Sa. Also, when only fortifying the spine of the sheet-bundle without flattening the back, the flattening roller 410 is evacuated from the one position to the evacuated position AP (see FIG. 6A) where the flattening roller 410 does not abut the spine Sb of the sheet-bundle Sa.

Whereas, in a sheet-bundle spine treatment apparatus 1400 according to a second embodiment shown in FIGS. 14 to 18C, the stopper 417 moves to a first position and a second position by a solenoid 601 (may also be a motor) so that there are two positions for receiving the sheet-bundle. Hence, the flattening roller 410 does not move relative to the casing 413.

At the first position, the spine of the sheet-bundle is fortified without flattening the back so that the first position is equivalent to the one position. At the second position, the back is flattened simultaneously performed with fortifying the spine of the sheet-bundle, and the second position is located on the downstream side of the first position. That is, the second position is equivalent to the evacuated position AP and located on the slightly downstream side of the flattening roller 410 which is located at the evacuated position AP.

In such a manner, in the sheet-bundle spine treatment apparatus 1400 according to the second embodiment, the sector gear 501, the pinion gear 502, and the flattening-roller separation motor M3 in the sheet-bundle spine treatment apparatus 400 according to the first embodiment are omitted, so that flattening the back of the sheet-bundle is performed in accordance with the position of the flattening roller 410.

Like reference characters designate like components common to the sheet-bundle spine treatment apparatus 400 according to the first embodiment, so that the description is partly omitted.

(Operation Description)

(Fortifying Processing of the Spine of the Sheet-Bundle (Pinching of the Spine))

Figure 15A:
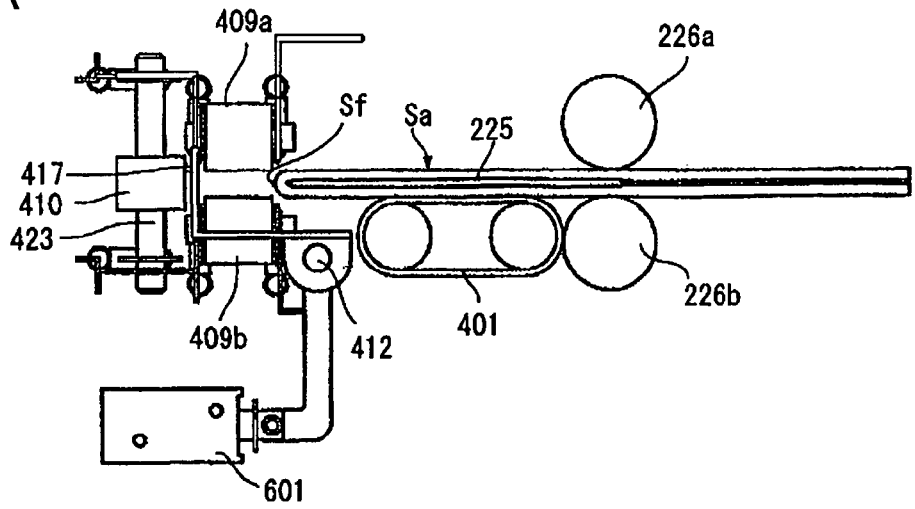
FIG. 15A is a drawing of the sheet-bundle spine treatment apparatus when the sheet-bundle is received.
Figure 15B:
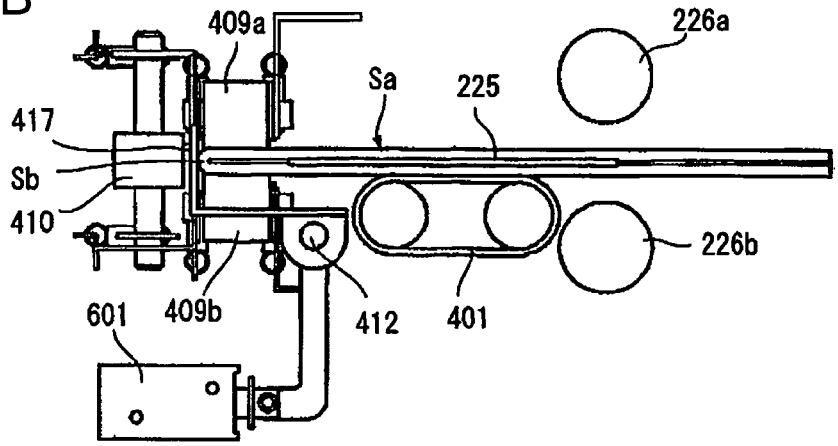
FIG. 15B is a drawing of a state when the sheet-bundle is stopped by the stopper.
Figure 15C:
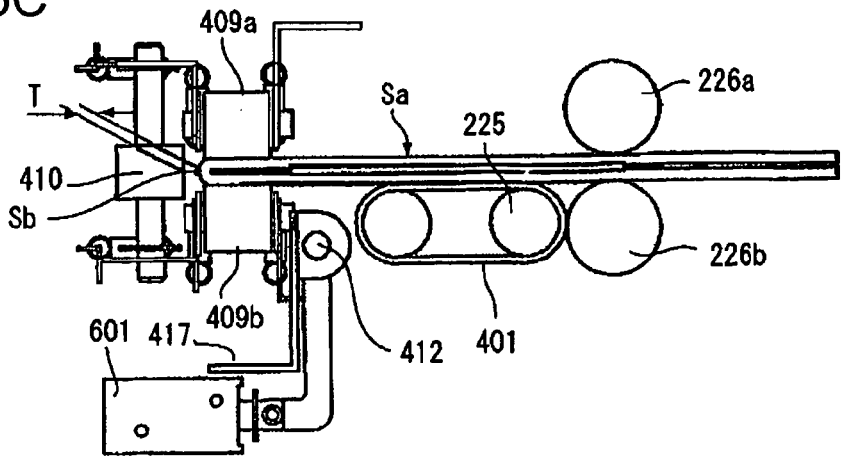
FIG. 15C is a drawing of a state when the stopper is evacuated.

This processing operation is the same as that of the sheet-bundle spine treatment apparatus 400 according to the first embodiment shown in FIGS. 6A to 7C, so that the outline will be described. Referring to FIGS. 15A to 16C, the saddle-stitched sheet-bundle Sa folded by the folding roller pair 226*a* and 226*b* and the protruding member 225 is conveyed to the stopper 417 by the folding roller pair 226*a* and 226*b*, the protruding member 225, and the booklet bundle conveying belt 401 for being received by the stopper 417. At this time, the stopper 417 is located at the first position. Then, as shown in FIG. 15C, the stopper 417 is evacuated downward. A constant distance T is secured between the spine Sb of the folded sheet-bundle Sa and the flattening roller 410.

Figure 16A:
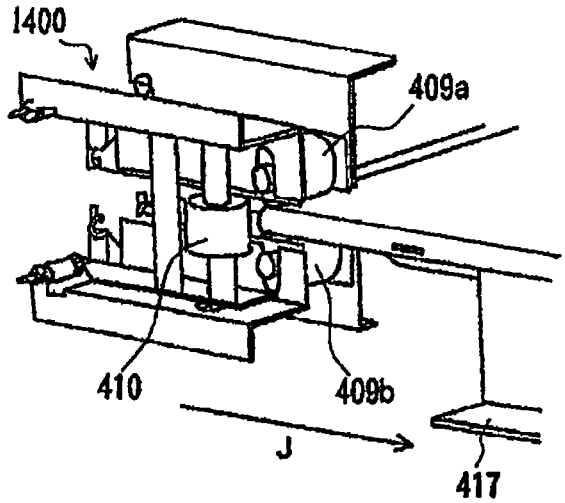
FIG. 16A is a drawing of a state when fortifying the sheet-bundle spine is started.
Figure 16B:
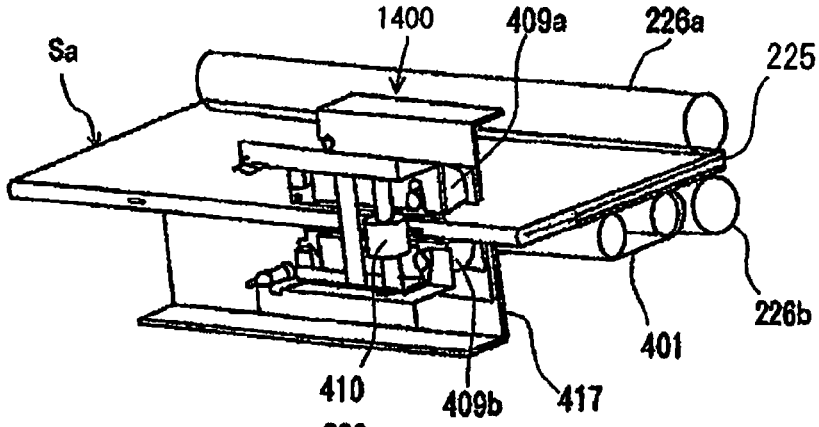
FIG. 16B is a drawing of a state when the sheet-bundle spine is fortified.

When the leading end of the folded sheet-bundle Sa is positioned, as shown in FIGS. 16A and 16B, the sheet-bundle spine treatment apparatus 1400 starts moving in arrow J direction. Then, the upper and lower press rollers 409*a* and 409*b* pinch the front and rear surfaces Sc and Sd of the spine Sb therebetween.

Then, the sheet-bundle spine treatment apparatus 1400 moves to the other end of the sheet-bundle. Meanwhile, the constant distance T is secured between the spine Sb of the folded sheet-bundle Sa and the flattening roller 410, so that the flattening roller 410 cannot be brought into contact with the back Sf of the sheet-bundle. Hence, the fortifying the spine of the sheet-bundle is only performed.

Figure 16C:
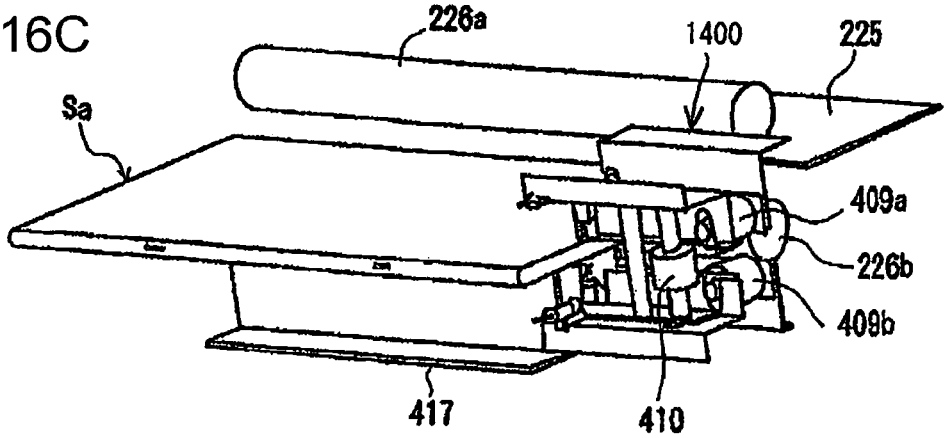
FIG. 16C is a drawing of a state when the sheet-bundle is discharged after flattening the sheet-bundle spine was finished.
Figure 17A:
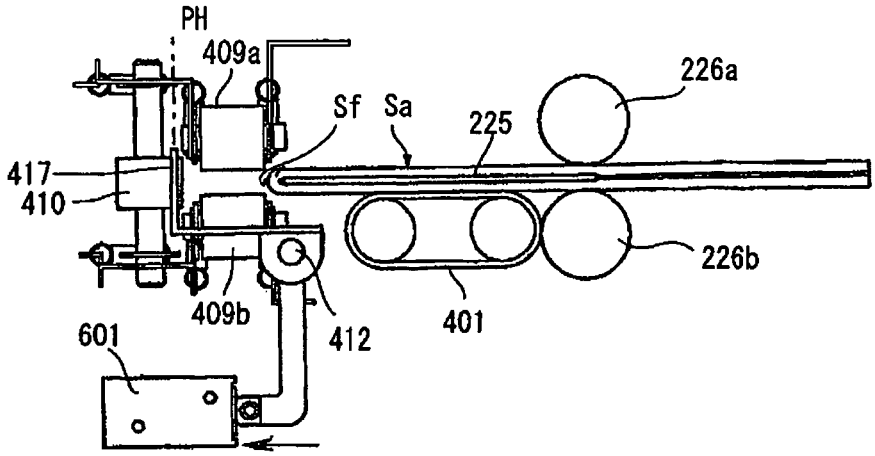
FIG. 17A is a drawing of the sheet-bundle spine treatment apparatus when the sheet-bundle is received.
Figure 17B:
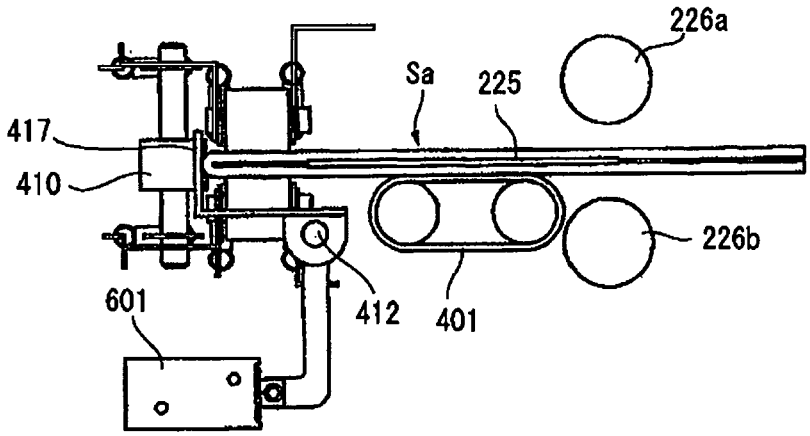
FIG. 17B is a drawing of a state when the sheet-bundle is stopped by the stopper.
Figure 17C:
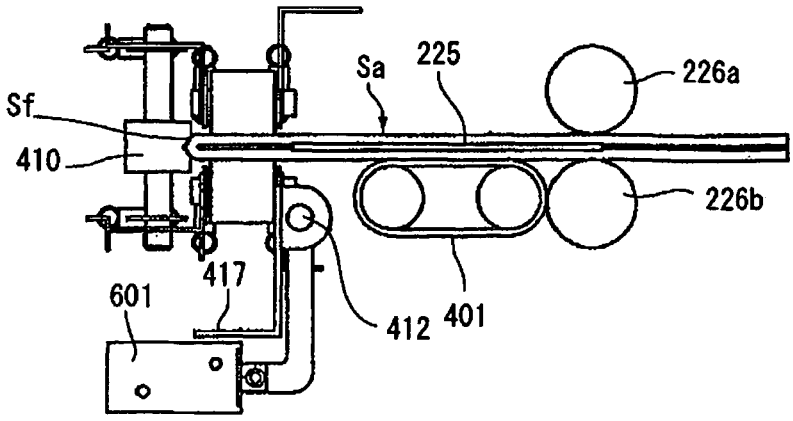
FIG. 17C is a drawing of a state when the stopper is evacuated.

Then, as shown in FIG. 16C, the folding roller pair 226*a* and 226*b* is again separated from the folded sheet-bundle Sa. Then, the protruding member 225 is evacuated to the rear of the folding roller pair 226*a* and 226*b* for preparing the saddle stitching of the next sheet-bundle. The folded sheet-bundle Sa with the fortified spine is discharged in the discharge tray 480 and sequentially placed thereon.

As shown in FIG. 8, the bulge of the spine Sb (backbone) can be reduced by the series of processing performed by the sheet-bundle spine treatment apparatus 1400 so as to provide high-quality sheet-bundles.

(Simultaneous Fortifying Processing of the Spine of the Sheet-Bundle (Pinching of the Spine) and Flattening Processing of the Back)

This processing operation is also the same as that of the sheet-bundle spine treatment apparatus 400 according to the first embodiment shown in FIGS. 9A to 10C, so that the outline will be described. Referring to FIGS. 17A to 18C, the sheet-bundle Sa saddle-stitched and folded by the folding roller pair 226*a* and 226*b* and the protruding member 225 is conveyed to the stopper 417 by the folding roller pair 226*a* and 226*b*, the protruding member 225, and the booklet bundle conveying belt 401. At this time, by turning on the solenoid 601, the stopper 417 is moved to a flattening-mode standby position PH so as to await receiving the spine Sb of the folded sheet-bundle Sa.

Figure 18A:
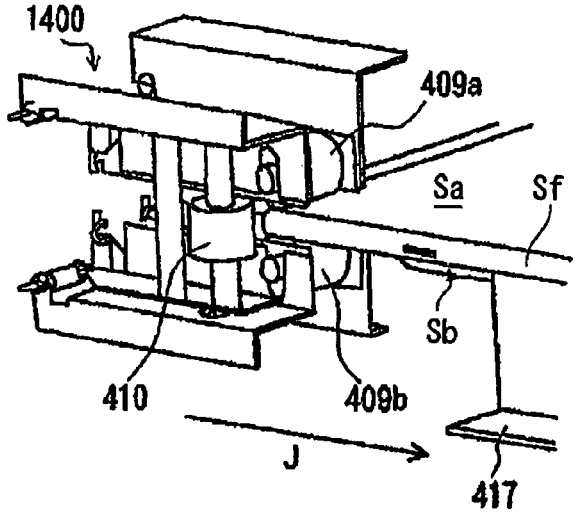
FIG. 18A is a drawing of a state when fortifying and flattening the sheet-bundle spine are started.
Figure 18B:
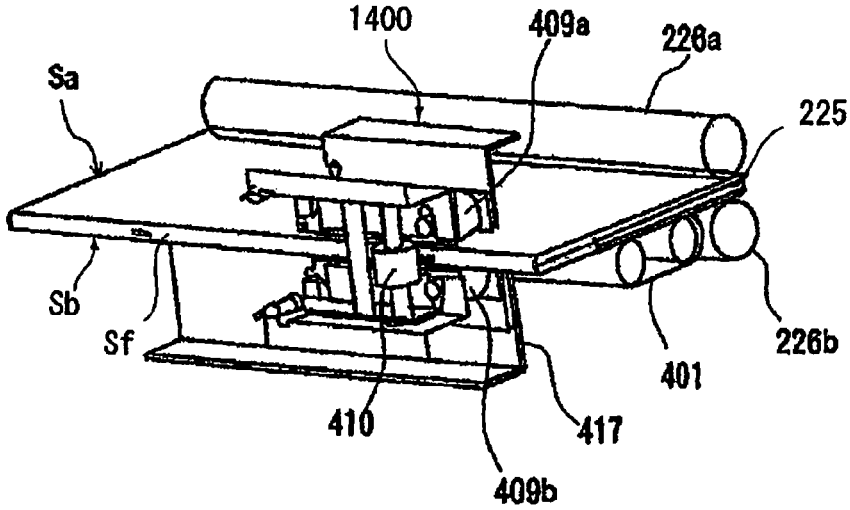
FIG. 18B is a drawing of a state when the sheet-bundle spine is fortified and flattened.

When the leading end of the folded sheet-bundle Sa is positioned, as shown in FIGS. 18A and 18B, the sheet-bundle spine treatment apparatus 1400 starts moving in arrow J direction. Then, the upper and lower press rollers 409*a* and 409*b* pinch the front and rear surfaces of the spine of the folded sheet-bundle Sa therebetween.

Thereafter, the flattening roller 410 moves along the spine Sb of the folded sheet-bundle Sa in retard to the upper and lower press rollers 409*a* and 409*b* by the distance L shown in FIG. 4 so as to follow them. Meanwhile, the upper and lower press rollers 409*a* and 409*b* fortify the spine of the sheet-bundle so as to secure the crease of the sheet-bundle, and the flattening roller 410 flattens the back so as to have the flattened back Sf.

Figure 18C:
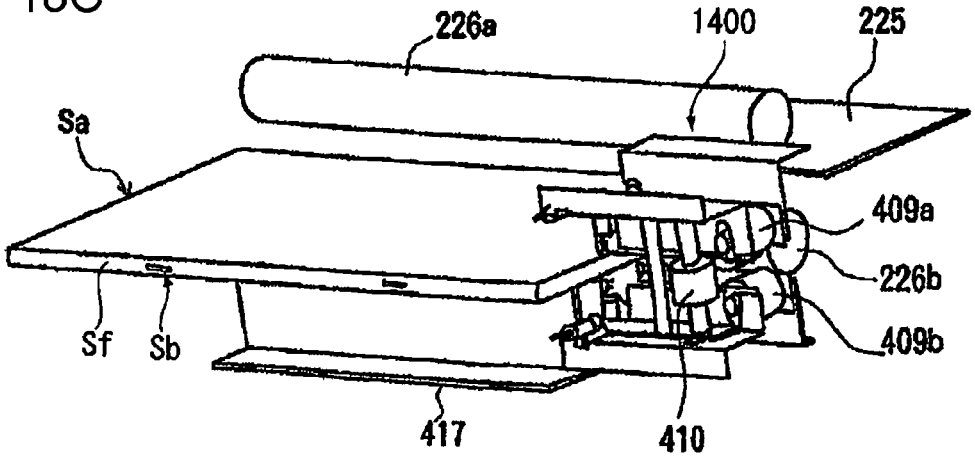
FIG. 18C is a drawing of a state when the sheet-bundle is discharged after fortifying and flattening the sheet-bundle spine were finished.

When the sheet-bundle spine treatment apparatus 1400 moves to the end of the sheet-bundle, it completes fortifying the spine crease and flattening the back. Then, as shown in FIG. 18C, the folding roller pair 226*a* and 226*b* is again separated from the folded sheet-bundle Sa. Then, the protruding member 225 is evacuated to the rear of the folding roller pair 226*a* and 226*b* for preparing the saddle stitching of the next sheet-bundle. The folded sheet-bundle Sa with the flattened spine is discharged in the discharge tray 480 and sequentially placed thereon.

As shown in FIG. 11, the bulge of the spine Sb (backbone) can be reduced by the series of processing performed by the sheet-bundle spine treatment apparatus 1400 so as to provide high-quality sheet-bundles.

As described above, in the sheet-bundle spine treatment apparatus 1400 according to the second embodiment, the standby position of the stopper 417 is changed by turning on/off the solenoid 601, so that the spine Sb of the folded sheet-bundle Sa is brought into and out of contact with the flattening roller 410.

Therefore, in order to fortify the spine Sb of the folded sheet-bundle Sa, the sheet-bundle spine treatment apparatus 1400 stops the back of the sheet-bundle at a position where the back of the sheet-bundle does not abut the flattening roller 410, so that the sheet-bundle can be securely creased by moving the upper and lower press rollers 409*a* and 409*b* while pinching the front and rear surfaces Sc and Sd in the vicinity of the spine therebetween.

Also, in order to flatten the back of the sheet-bundle, the sheet-bundle spine treatment apparatus 1400 stops the back of the sheet-bundle at a position where the back of the sheet-bundle abuts the flattening roller 410. Then, the upper and lower press rollers 409*a* and 409*b* are moved while pinching the front and rear surfaces Sc and Sd in the vicinity of the spine therebetween, and the flattening roller 410 is also moved while pushing the back Sf in the vicinity of the front and rear surfaces Sc and Sd pinched with the upper and lower press rollers 409*a* and 409*b*.

In the sheet-bundle spine treatment apparatus 1400 according to the embodiment, in the same way as in the sheet-bundle spine treatment apparatus 400 according to the first embodiment, the processing is selected by a choice of a user who pushes whether the "fortifying spine crease" button 1001 or the "flattening back" button 1002 on the user operation panel 1000 shown in FIG. 13. Furthermore, when a user selects the "optimum treatment" button 1003, the sheet-bundle spine treatment apparatus 1400 according to the embodiment automatically performs the fortifying spine crease processing and the flattening back processing when the thickness of the sheet-bundle is large (10 mm or more, for example) while performs only the fortifying spine crease processing when thickness of the sheet-bundle is small (less than 10 mm, for example).

In such a manner, the sheet-bundle spine treatment apparatus 1400 according to the embodiment can also perform the sheet-bundle treatment with one apparatus, which has been only performed by separate apparatuses. Moreover, a user can select the processing. Furthermore, the optimum treatment for the sheet-bundle can be automatically selected in accordance with the thickness of the sheet-bundle.

In the sheet-bundle spine treatment apparatuses 400 and 1400 according to the first and second embodiments described above, the fortifying treatment or the flattening treatment of the spine of the stitched sheet-bundle is performed. Alternatively, on the non-stitched sheet-bundle, the same treatment may be performed.

The press-roller 409*a* or 409*b* described above can be a pinching roller. However, it is not necessarily a roller, so that it may also be a rotatable endless belt or a spatulate member. The flattening roller 410 is also not necessarily a roller, so that it may also be a rotatable endless belt or a spatulate member.

Figure 19:
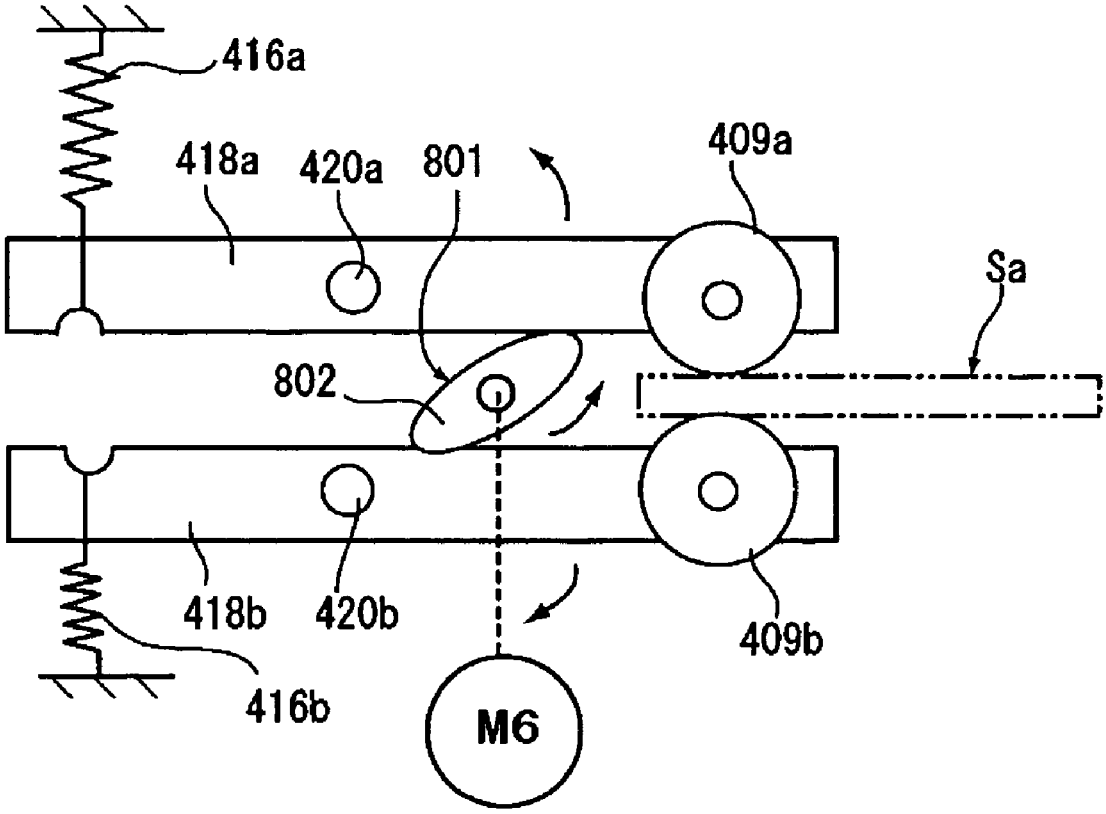
FIG. 19 is a schematic view of a mechanism for separating upper and lower press-rollers from the sheet-bundle.

While the pinching press-rollers 409*a* and 409*b* are separated from each other so as to be out of contact with the sheet-bundle by a cam 802 in a press-roller separation mechanism 801 shown in FIG. 19 and driven by a motor M6 or a solenoid (not shown), by bringing only the flattening roller 410 into contact with the sheet-bundle back, one or both of the fortifying treatment of the sheet-bundle spine (the pinching treatment of the spine) and the flattening treatment of the spine back can also be performed selectively. The cam 802 in the press-roller separation mechanism 801 is operated by pushing a "flattening back" button on the user operation panel shown in FIG. 13. The selection portion in this case is constituted by the user operation panel, the controller 701 of the saddle-stitch bookbinding apparatus (see FIG. 20), and the press-roller separation mechanism 801.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-147353 filed May 19, 2005, which is hereby incorporated by reference herein in its entirety.

What is claimed is:

1. An image-forming apparatus comprising:

an image-forming portion configured to form images on a sheet; and a sheet-bundle treatment apparatus configured to fold the sheet having the images formed by the image-forming portion in bundles and treats a spine of the folded sheet-bundle, the sheet-bundle treatment apparatus including:

a crease treatment unit configured to press a crease of a folded sheet-bundle while moving along a spine of the sheet-bundle in order to perform a spine crease treatment for fortifying the crease of the folded sheet-bundle;

a back treatment unit configured to push a back of the spine of the folded sheet-bundle while moving along the spine of the sheet-bundle in order to perform a flattening treatment for flattening the back of the spine of the sheet-bundle; and a selection portion facilitating selecting operation of at least one of the crease treatment unit and the back treatment unit.

2. The image-forming apparatus according to claim 1, wherein the crease treatment unit includes a pair of pinching members that pinch the front and rear surfaces of the spine therebetween while moving along the spine, and wherein the back treatment unit includes a pushing member that pushes the back of the spine while moving along the spine.

3. The image-forming apparatus according to claim 2, further comprising a common movable body supporting the pair of pinching members and the pushing member and being movable along the spine.

4. The image-forming apparatus according to claim 2, further comprising a moving portion which moves the pushing member between a pushing position, where the back of the spine is pushed, and an evacuated position evacuated from the pushing position, wherein responsive to the selection portion selecting the back treatment unit, the moving portion moves the pushing member to the pushing position from the evacuated position.

5. A sheet-bundle spine treatment apparatus comprising:

a crease treatment unit configured to press a crease of a folded sheet-bundle while moving along a spine of the folded sheet-bundle in order to perform a spine crease treatment for fortifying the crease of the folded sheet-bundle;

a back treatment unit configured to push a back of the spine of the folded sheet-bundle while moving along the spine of the folded sheet-bundle in order to perform a flattening treatment for flattening the back of the spine; and a controller configured to control the crease treatment unit and the back treatment unit so as to selectively perform the spine crease treatment and the flattening treatment, wherein the crease treatment unit includes a pair of pinching members that pinch front and rear surfaces of the spine therebetween while moving along the spine, wherein the back treatment unit includes a pushing member that pushes the back of the spine while moving along the spine, and wherein the pair of pinching members and the pushing member are supported on a common movable body and the common movable body is movable along the spine.

6. A sheet-bundle spine treatment apparatus comprising:

a crease treatment unit configured to press a crease of a folded sheet-bundle while moving along a spine of the folded sheet-bundle in order to perform a spine crease treatment for fortifying the crease of the folded sheet-bundle;

a back treatment unit configured to push a back of the spine of the folded sheet-bundle while moving along the spine of the folded sheet-bundle in order to perform a flattening treatment for flattening the back of the spine; and a controller configured to control the crease treatment unit and the back treatment unit so as to selectively perform the spine crease treatment and the flattening treatment, wherein the crease treatment unit includes a pair of pinching members that pinch front and rear surfaces of the spine therebetween while moving along the spine, wherein the back treatment unit includes a pushing member that pushes the back of the spine while moving along the spine, wherein the pushing member is moved by a moving portion between a pushing position, where the back of the spine is pushed, and an evacuated position evacuated from the pushing position, and wherein when the flattening treatment is selected, the moving portion moves the pushing member to the pushing position from the evacuated position.

7. A sheet-bundle spine treatment apparatus comprising:

a crease treatment unit configured to press a crease of a folded sheet-bundle while moving along a spine of the folded sheet-bundle in order to perform a spine crease treatment for fortifying the crease of the folded sheet-bundle;

a back treatment unit configured to push a back of the spine of the folded sheet-bundle while moving along the spine of the folded sheet-bundle in order to perform a flattening treatment for flattening the back of the spine;

a controller configured to control the crease treatment unit and the back treatment unit so as to selectively perform the spine crease treatment and the flattening treatment; and a stopper which receives the back of the spine of the sheet-bundle at a position where the back treatment unit can push the back.

8. A sheet-bundle spine treatment apparatus comprising:

a crease treatment unit configured to press a crease of a folded sheet-bundle while moving along a spine of the folded sheet-bundle in order to perform a spine crease treatment for fortifying the crease of the folded sheet-bundle;

a back treatment unit configured to push a back of the spine of the folded sheet-bundle while moving along the spine of the folded sheet-bundle in order to perform a flattening treatment for flattening the back of the spine;

a controller configured to control the crease treatment unit and the back treatment unit so as to selectively perform the spine crease treatment and the flattening treatment; and a stopper which receives the sheet-bundle and is movable to a first position where the sheet-bundle is pinched by the crease treatment unit and to a second position where the sheet-bundle is pushed by the back treatment unit.

9. A sheet-bundle treatment apparatus comprising:

a folding unit configured to fold a sheet-bundle; and a sheet-bundle spine treatment apparatus configured to treat a spine of the sheet-bundle folded by the folding unit, the sheet-bundle spine treatment apparatus including:

a crease treatment unit configured to press a crease of a folded sheet-bundle while moving along a spine of the sheet-bundle in order to perform a spine crease treatment for fortifying the crease of the folded sheet-bundle;

a back treatment unit configured to push a back of the spine of the folded sheet-bundle while moving along the spine of the sheet-bundle in order to perform a flattening treatment for flattening the back of the spine of the sheet-bundle; and a controller configured to control the crease treatment unit and the back treatment unit so as to selectively perform the spine crease treatment and the flattening treatment, wherein the crease treatment unit includes a pair of pinching members that pinch front and rear surfaces of the spine therebetween while moving along the spine, wherein the back treatment unit includes a pushing member that pushes the back of the spine while moving along the spine, and wherein the pair of pinching members and the pushing member are supported on a common movable body and the common movable body is movable along the spine.

10. A sheet-bundle treatment apparatus comprising:

a folding unit configured to fold a sheet-bundle; and a sheet-bundle spine treatment apparatus configured to treat a spine of the sheet-bundle folded by the folding unit, the sheet-bundle spine treatment apparatus including:

a crease treatment unit configured to press a crease of a folded sheet-bundle while moving along a spine of the sheet-bundle in order to perform a spine crease treatment for fortifying the crease of the folded sheet-bundle;

a back treatment unit configured to push a back of the spine of the folded sheet-bundle while moving along the spine of the sheet-bundle in order to perform a flattening treatment for flattening the back of the spine of the sheet-bundle; and a controller configured to control the crease treatment unit and the back treatment unit so as to selectively perform the spine crease treatment and the flattening treatment, wherein the crease treatment unit includes a pair of pinching members that pinch front and rear surfaces of the spine therebetween while moving along the spine, wherein the back treatment unit includes a pushing member that pushes the back of the spine while moving along the spine, wherein the pushing member is moved by a moving portion between a pushing position, where the back of the spine is pushed, and an evacuated position evacuated from the pushing position, and wherein when the flattening treatment is selected, the moving portion moves the pushing member to the pushing position from the evacuated position.

11. A sheet-bundle treatment apparatus comprising:

a folding unit configured to fold a sheet-bundle;

a sheet-bundle spine treatment apparatus configured to treat a spine of the sheet-bundle folded by the folding unit, the sheet-bundle spine treatment apparatus including:

a crease treatment unit configured to press a crease of a folded sheet-bundle while moving along a spine of the sheet-bundle in order to perform a spine crease treatment for fortifying the crease of the folded sheet-bundle;

a back treatment unit configured to push a back of the spine of the folded sheet-bundle while moving along the spine of the sheet-bundle in order to perform a flattening treatment for flattening the back of the spine of the sheet-bundle; and a controller configured to control the crease treatment unit and the back treatment unit so as to selectively perform the spine crease treatment and the flattening treatment; and a stopper which receives the back of the spine of the sheet-bundle at a position where the back treatment unit can push the back.

12. A sheet-bundle treatment apparatus comprising:

a folding unit configured to fold a sheet-bundle;

a sheet-bundle spine treatment apparatus configured to treat a spine of the sheet-bundle folded by the folding unit, the sheet-bundle spine treatment apparatus including:

a crease treatment unit configured to press a crease of a folded sheet-bundle while moving along a spine of the sheet-bundle in order to perform a spine crease treatment for fortifying the crease of the folded sheet-bundle;

a back treatment unit configured to push a back of the spine of the folded sheet-bundle while moving along the spine of the sheet-bundle in order to perform a flattening treatment for flattening the back of the spine of the sheet-bundle; and a controller configured to control the crease treatment unit and the back treatment unit so as to selectively perform the spine crease treatment and the flattening treatment; and a stopper which receives the sheet-bundle and is movable to a first position where the sheet-bundle is pinched by the crease treatment unit and to a second position where the sheet-bundle is pushed by the back treatment unit.

13. An image-forming apparatus comprising:

an image-forming portion configured to form images on a sheet; and a sheet-bundle treatment apparatus comprising:

a folding unit configured to fold a sheet-bundle; and a sheet-bundle spine treatment apparatus configured to treat a spine of the sheet-bundle folded by the folding unit, the sheet-bundle spine treatment apparatus including:

a crease treatment unit configured to press a crease of a folded sheet-bundle while moving along a spine of the sheet-bundle in order to perform a spine crease treatment for fortifying the crease of the folded sheet-bundle;

a back treatment unit configured to push a back of the spine of the folded sheet-bundle while moving along the spine of the sheet-bundle in order to perform a flattening treatment for flattening the back of the spine of the sheet-bundle; and a controller configured to control the crease treatment unit and the back treatment unit so as to selectively perform the spine crease treatment and the flattening treatment.

14. The image-forming apparatus according to claim 13, wherein the crease treatment unit includes a pair of pinching members that pinch front and rear surfaces of the spine therebetween while moving along the spine, and wherein the back treatment unit includes a pushing member that pushes the back of the spine while moving along the spine.

15. The image-forming apparatus according to claim 14, further comprising a common movable body supporting the pair of pinching members and the pushing member and being movable along the spine.

16. The image-forming apparatus according to claim 14, further comprising a moving portion which moves the pushing member between a pushing position, where the back of the spine is pushed, and an evacuated position evacuated from the pushing position, wherein responsive to the selection portion selecting the back treatment unit, the moving portion moves the pushing member to the pushing position from the evacuated position.

* * * * *